US010253457B2

(12) United States Patent
Husband et al.

(10) Patent No.: US 10,253,457 B2
(45) Date of Patent: Apr. 9, 2019

(54) COMPOSITIONS

(71) Applicant: FiberLean Technologies Limited, Par, Cornwall (GB)

(72) Inventors: John Claude Husband, St. Austell (GB); Per Svending, Kungalv (SE); David Robert Skuse, Truro (GB)

(73) Assignee: FiberLean Technologies Limited, Par, Cornwall (GB)

( * ) Notice: Subject to any disclaimer, the term of this patent is extended or adjusted under 35 U.S.C. 154(b) by 0 days.

(21) Appl. No.: 15/132,970

(22) Filed: Apr. 19, 2016

(65) Prior Publication Data

US 2016/0230341 A1 Aug. 11, 2016

Related U.S. Application Data

(63) Continuation of application No. 13/884,279, filed as application No. PCT/GB2011/052181 on Nov. 9, 2011, now abandoned.

(30) Foreign Application Priority Data

Nov. 15, 2010 (GB) ..... 1019288.8
Aug. 5, 2011 (GB) ..... 1113559.7

(51) Int. Cl.

| | |
|---|---|
| ***D21H 19/34*** | (2006.01) |
| ***D21H 19/22*** | (2006.01) |
| ***D21H 27/10*** | (2006.01) |
| ***D21H 19/38*** | (2006.01) |
| ***D21H 17/25*** | (2006.01) |
| ***D21H 19/52*** | (2006.01) |
| ***D21H 17/63*** | (2006.01) |
| ***D21H 11/04*** | (2006.01) |
| ***D21H 23/48*** | (2006.01) |

(52) U.S. Cl.

CPC ..... *D21H 19/34* (2013.01); *D21H 17/25* (2013.01); *D21H 17/63* (2013.01); *D21H 19/22* (2013.01); *D21H 19/38* (2013.01); *D21H 19/52* (2013.01); *D21H 23/48* (2013.01); *D21H 27/10* (2013.01); *D21H 11/04* (2013.01); *Y10T 428/31703* (2015.04); *Y10T 428/31982* (2015.04); *Y10T 428/31993* (2015.04)

(58) Field of Classification Search

None

See application file for complete search history.

(56) References Cited

U.S. PATENT DOCUMENTS

| | | | |
|---|---|---|---|
| 57,307 | A | 8/1866 | Fletcher |
| 168,783 | A | 10/1875 | Riley |
| 2,006,209 | A | 5/1933 | Bradner |
| 3,075,710 | A | 1/1963 | Feld et al. |
| 3,765,921 | A | 10/1973 | Puskar |
| 3,794,558 | A | 2/1974 | Back |
| 3,820,548 | A | 6/1974 | Buchmann et al. |
| 3,921,581 | A | 11/1975 | Brewer |
| 4,026,762 | A | 5/1977 | Bauman |
| 4,087,317 | A | 5/1978 | Roberts |
| 4,167,548 | A | 9/1979 | Arduini et al. |
| 4,229,250 | A | 10/1980 | Lehtinen |
| 4,275,084 | A | 6/1981 | Ohyabu et al. |
| 4,285,842 | A | 8/1981 | Herr |
| 4,318,959 | A | 3/1982 | Evans et al. |
| 4,341,807 | A | 7/1982 | Turbak et al. |
| 4,356,060 | A | 10/1982 | Neckermann et al. |
| 4,374,702 | A | 2/1983 | Turbak et al. |
| 4,378,381 | A | 3/1983 | Turbak et al. |
| 4,452,721 | A | 6/1984 | Turbak et al. |
| 4,452,722 | A | 6/1984 | Turbak et al. |
| 4,460,737 | A | 7/1984 | Evans et al. |
| 4,464,287 | A | 8/1984 | Turbak et al. |
| 4,474,949 | A | 10/1984 | Chatterjee et al. |
| 4,481,076 | A | 11/1984 | Herrick |
| 4,481,077 | A | 11/1984 | Herrick |
| 4,487,634 | A | 12/1984 | Turbak et al. |
| 4,500,546 | A | 2/1985 | Turbak et al. |
| 4,510,020 | A | 4/1985 | Green et al. |
| 4,705,712 | A | 11/1987 | Cashaw et al. |
| 4,744,987 | A | 5/1988 | Mehra et al. |
| 4,761,203 | A | 8/1988 | Vinson |
| 4,820,813 | A | 4/1989 | Schulz |
| 4,889,594 | A | 12/1989 | Gavelin |
| 4,952,278 | A | 8/1990 | Gregory et al. |
| 5,009,886 | A | 4/1991 | Ahmad et al. |
| 5,098,520 | A | 3/1992 | Begala |
| 5,104,411 | A | 4/1992 | Makoui et al. |
| 5,123,962 | A | 6/1992 | Komuro et al. |
| 5,223,090 | A | 6/1993 | Klungness et al. |
| 5,227,024 | A | 6/1993 | Gomez |
| 5,225,041 | A | 7/1993 | Richard et al. |
| 5,228,900 | A | 7/1993 | Stephens et al. |
| 5,240,561 | A | 8/1993 | Kaliski |
| 5,244,542 | A | 9/1993 | Bown et al. |
| 5,269,470 | A | 12/1993 | Ishikawa et al. |
| 5,274,199 | A | 12/1993 | Uryu et al. |
| 5,279,663 | A | 1/1994 | Kaliski |
| 5,312,484 | A | 5/1994 | Kaliski |
| 5,316,621 | A | 5/1994 | Kitao et al. |
| 5,385,640 | A | 1/1995 | Weibel et al. |
| 5,443,902 | A | 8/1995 | Knox et al. |
| 5,576,617 | A | 11/1996 | Webb et al. |
| 5,731,080 | A | 3/1998 | Cousin et al. |
| 5,817,381 | A | 10/1998 | Chen et al. |
| 5,837,376 | A | 11/1998 | Knox et al. |
| 5,840,320 | A | 11/1998 | Odom |
| 5,964,983 | A | 10/1999 | Dinand et al. |

(Continued)

FOREIGN PATENT DOCUMENTS

| | | | |
|---|---|---|---|
| AU | 2010247184 | B2 | 1/2013 |
| BE | 1006908 | A3 | 1/1995 |

(Continued)

OTHER PUBLICATIONS

International Search Report and Written Opinion dated Aug. 21, 2012, in International Application No. PCT/GB2011/052181.

(Continued)

*Primary Examiner* — Sheeba Ahmed

(74) *Attorney, Agent, or Firm* — Pierce Atwood LLP; Raymond G. Arner

(57) ABSTRACT

Compositions such as filled and coated papers may include microfibrillated cellulose and inorganic particulate material.

20 Claims, No Drawings

(56) References Cited

U.S. PATENT DOCUMENTS

| | | | |
|---|---|---|---|
| 6,037,380 | A | 3/2000 | Venables et al. |
| 6,074,524 | A | 6/2000 | Wu et al. |
| 6,083,582 | A | 7/2000 | Chen et al. |
| 6,102,946 | A | 8/2000 | Nigam |
| 6,117,305 | A | 9/2000 | Bando et al. |
| 6,117,474 | A | 9/2000 | Kamada et al. |
| 6,117,545 | A | 9/2000 | Cavaille et al. |
| 6,117,804 | A | 9/2000 | Cho |
| 6,132,558 | A | 10/2000 | Dyllick-Brenzinger et al. |
| 6,156,118 | A | 12/2000 | Silenius |
| 6,159,335 | A | 12/2000 | Owens et al. |
| 6,183,596 | B1 * | 2/2001 | Matsuda ..... D21C 9/007 162/100 |
| 6,202,946 | B1 | 3/2001 | Virtanen |
| 6,214,163 | B1 | 4/2001 | Matsuda et al. |
| 6,235,150 | B1 | 5/2001 | Middleton et al. |
| 6,312,669 | B1 | 11/2001 | Cantiani et al. |
| 6,339,898 | B1 | 1/2002 | Toye |
| 6,379,594 | B1 | 4/2002 | Döpfner et al. |
| 6,436,232 | B1 | 8/2002 | Silenius et al. |
| 6,579,410 | B1 | 6/2003 | Bleakley et al. |
| 6,604,698 | B2 | 8/2003 | Verhoff et al. |
| 6,647,662 | B2 | 11/2003 | Toye |
| 6,669,882 | B2 | 12/2003 | Seok |
| 6,726,807 | B1 | 4/2004 | Mathur |
| 6,787,497 | B2 | 9/2004 | Dellve et al. |
| 6,861,081 | B2 | 3/2005 | Weibel |
| 7,022,756 | B2 | 4/2006 | Singer |
| 7,048,900 | B2 | 5/2006 | Mathur et al. |
| 7,083,703 | B2 | 8/2006 | Aho et al. |
| 7,169,258 | B2 | 1/2007 | Rheims et al. |
| 7,179,347 | B2 | 2/2007 | Rheims et al. |
| 7,285,182 | B2 | 10/2007 | Mason et al. |
| 7,381,294 | B2 | 6/2008 | Suzuki et al. |
| 7,459,493 | B2 | 12/2008 | Singer |
| 7,462,232 | B2 | 12/2008 | Tuason et al. |
| 7,594,619 | B2 | 9/2009 | Ghere, Jr. et al. |
| 7,726,592 | B2 | 6/2010 | Fernandez et al. |
| 7,790,276 | B2 | 9/2010 | Kanakarajan |
| 7,799,358 | B2 | 9/2010 | Weibel |
| 8,012,312 | B2 | 9/2011 | Goto et al. |
| 8,728,273 | B2 | 5/2014 | Heiskanen et al. |
| 2001/0011516 | A1 | 8/2001 | Cantiani et al. |
| 2002/0031592 | A1 | 3/2002 | Weibel |
| 2002/0059886 | A1 | 5/2002 | Merkley et al. |
| 2002/0081362 | A1 | 6/2002 | Weibel |
| 2002/0198293 | A1 | 12/2002 | Craun et al. |
| 2003/0051841 | A1 | 3/2003 | Mathur et al. |
| 2003/0094252 | A1 | 5/2003 | Sundar et al. |
| 2003/0114641 | A1 | 6/2003 | Kelly et al. |
| 2004/0108081 | A1 | 6/2004 | Hughes |
| 2004/0146605 | A1 | 7/2004 | Weibel |
| 2004/0149403 | A1 | 8/2004 | Rheims et al. |
| 2004/0168782 | A1 | 9/2004 | Silenius et al. |
| 2004/0168783 | A1 | 9/2004 | Munchow |
| 2004/0173329 | A1 | 9/2004 | Silenius et al. |
| 2005/0000665 | A1 | 1/2005 | Doelle |
| 2005/0045288 | A1 | 3/2005 | Riou |
| 2005/0051054 | A1 | 3/2005 | White et al. |
| 2005/0089601 | A1 | 4/2005 | Weibel |
| 2005/0103459 | A1 | 5/2005 | Mathur |
| 2005/0133643 | A1 | 6/2005 | Fernandez et al. |
| 2005/0194477 | A1 | 9/2005 | Suzuki |
| 2005/0256262 | A1 | 11/2005 | Hill et al. |
| 2006/0078647 | A1 | 4/2006 | Weibel |
| 2006/0201646 | A1 | 9/2006 | Gussinyer Canadell |
| 2006/0266485 | A1 | 11/2006 | Knox et al. |
| 2006/0280839 | A1 | 12/2006 | Weibel |
| 2006/0289132 | A1 | 12/2006 | Heijnesson-Hulten |
| 2007/0062009 | A1 | 3/2007 | Ghere, Jr. et al. |
| 2007/0131361 | A1 | 6/2007 | Doelle et al. |
| 2007/0148365 | A1 | 6/2007 | Knox et al. |
| 2007/0224419 | A1 | 9/2007 | Sumnicht et al. |
| 2007/0226919 | A1 | 10/2007 | Mheidle |
| 2007/0231568 | A1 | 10/2007 | Kanakarajan |
| 2007/0272376 | A1 | 11/2007 | Maijala et al. |
| 2008/0023161 | A1 | 1/2008 | Gather |
| 2008/0057307 | A1 | 3/2008 | Koslow et al. |
| 2008/0060774 | A1 | 3/2008 | Zuraw et al. |
| 2008/0146701 | A1 | 6/2008 | Sain et al. |
| 2008/0210391 | A1 | 9/2008 | Pfalzer et al. |
| 2008/0265222 | A1 | 10/2008 | Ozersky et al. |
| 2009/0020139 | A1 | 1/2009 | Sumnicht et al. |
| 2009/0020248 | A1 | 1/2009 | Sumnicht et al. |
| 2009/0065164 | A1 | 3/2009 | Goto et al. |
| 2009/0084874 | A1 | 4/2009 | Alam et al. |
| 2009/0221812 | A1 | 9/2009 | Ankerfors et al. |
| 2010/0059191 | A1 | 3/2010 | Garcia Melgarejo et al. |
| 2010/0132901 | A1 | 6/2010 | Wild |
| 2010/0139527 | A1 | 6/2010 | Fernandez-Garcia |
| 2010/0212850 | A1 | 8/2010 | Sumnicht et al. |
| 2011/0088860 | A1 | 4/2011 | Heijnesson-Hulten et al. |
| 2011/0114765 | A1 | 5/2011 | Brady et al. |

FOREIGN PATENT DOCUMENTS

| | | | |
|---|---|---|---|
| CA | 1096676 | A | 3/1981 |
| CA | 1149219 | A | 7/1983 |
| CA | 1162819 | A | 2/1984 |
| CA | 2292587 | A1 | 12/1998 |
| CA | 2093545 | C | 3/2001 |
| CA | 2437616 | A1 | 2/2005 |
| CA | 2750082 | A1 | 8/2010 |
| CH | 648071 | A5 | 2/1985 |
| CN | 1173904 | A | 2/1998 |
| CN | 1278830 | A | 1/2001 |
| CN | 1086189 | C | 6/2002 |
| CN | 1585839 | A | 2/2005 |
| CN | 1325725 | C | 9/2005 |
| DK | 175143 | B1 | 6/2004 |
| EP | 0039628 | A1 | 11/1981 |
| EP | 0051230 | A1 | 5/1982 |
| EP | 0273745 | B1 | 2/1991 |
| EP | 0442183 | A1 | 8/1991 |
| EP | 0492600 | A1 | 7/1992 |
| EP | 0499578 | A1 | 8/1992 |
| EP | 0579171 | A1 | 1/1994 |
| EP | 0614948 | B1 | 9/1994 |
| EP | 0619140 | A2 | 10/1994 |
| EP | 0785307 | A2 | 7/1997 |
| EP | 0790135 | A2 | 8/1997 |
| EP | 0988322 | B1 | 1/2002 |
| EP | 1053213 | B1 | 5/2002 |
| EP | 1469126 | A1 | 10/2004 |
| EP | 1 538 257 | A1 | 6/2005 |
| EP | 1936032 | A1 | 6/2008 |
| EP | 2196579 | A1 | 6/2010 |
| EP | 2216345 | A1 | 8/2010 |
| EP | 2 236 664 | A1 | 10/2010 |
| EP | 2236545 | A1 | 10/2010 |
| EP | 2236664 | A1 | 10/2010 |
| ES | 2100781 | A1 | 6/1997 |
| FR | 2689530 | A1 | 10/1993 |
| FR | 2774702 | A1 | 8/1999 |
| GB | 663621 | A | 12/1951 |
| GB | 2 260 146 | A | 4/1993 |
| GB | 2260146 | A | 4/1993 |
| GB | 2265916 | A | 10/1993 |
| GB | 2275876 | A | 9/1994 |
| JP | S59132926 | A | 7/1984 |
| JP | 1-156587 | A | 6/1989 |
| JP | H05-098589 | A | 4/1993 |
| JP | 6-158585 | A | 6/1994 |
| JP | 08-081896 | A | 3/1996 |
| JP | H08-81896 | A | 3/1996 |
| JP | 2528487 | B2 | 8/1996 |
| JP | 8-284090 | A | 10/1996 |
| JP | 08-284090 | A | 10/1996 |
| JP | 9-124702 | A | 5/1997 |
| JP | 10-158303 | A | 6/1998 |
| JP | 2976485 | B2 | 11/1999 |
| JP | 2004-523676 | A | 8/2004 |
| JP | 2004231796 | A | 8/2004 |
| JP | 2006008857 | A | 1/2006 |

(56) References Cited

FOREIGN PATENT DOCUMENTS

| | | | |
|---|---|---|---|
| JP | 2007-262594 | A | 10/2007 |
| JP | WO 2008/033283 | A1 | 3/2008 |
| JP | 2008-169497 | A | 7/2008 |
| JP | 2009-161613 | A | 7/2009 |
| JP | 2009-243014 | A | 10/2009 |
| JP | 2009-263854 | A | 11/2009 |
| JP | 2010-503775 | A | 2/2010 |
| JP | 2010-513741 | A | 4/2010 |
| JP | 2010-168716 | A | 8/2010 |
| JP | 2012-522145 | A | 9/2012 |
| JP | 2013-527333 | A | 6/2013 |
| JP | 2014-503696 | A | 2/2014 |
| JP | 5572169 | B2 | 7/2014 |
| KR | 10-2009-0109532 | A | 10/2009 |
| NL | 8102857 | A | 1/1983 |
| SU | 499366 | A1 | 1/1977 |
| TW | 201013017 | A | 4/2010 |
| WO | 93/01333 | A1 | 1/1993 |
| WO | 93/15270 | A1 | 8/1993 |
| WO | 94/04745 | A1 | 3/1994 |
| WO | 97/18897 | A2 | 5/1997 |
| WO | 98/55693 | A1 | 12/1998 |
| WO | 98/56826 | A1 | 12/1998 |
| WO | 99/54045 | A1 | 10/1999 |
| WO | 00/66510 | A1 | 11/2000 |
| WO | 01/66600 | A1 | 9/2001 |
| WO | 01/98231 | A1 | 12/2001 |
| WO | 02/086238 | A1 | 10/2002 |
| WO | 02/100955 | A | 12/2002 |
| WO | 03/033815 | A2 | 4/2003 |
| WO | 03/044250 | A1 | 5/2003 |
| WO | 2004/016852 | A2 | 2/2004 |
| WO | 2004/055267 | A1 | 7/2004 |
| WO | 2005/014934 | A2 | 2/2005 |
| WO | 2005/100489 | A1 | 10/2005 |
| WO | 2005/123840 | A1 | 12/2005 |
| WO | 2006/009502 | A1 | 1/2006 |
| WO | 2007/088974 | A1 | 8/2007 |
| WO | 2007/091942 | A2 | 8/2007 |
| WO | 2007/096180 | A2 | 8/2007 |
| WO | 2007/110639 | A1 | 10/2007 |
| WO | 2008/076056 | A1 | 6/2008 |
| WO | 2008/076071 | A1 | 6/2008 |
| WO | WO 2008/076056 | A1 | 6/2008 |
| WO | 2008/095764 | A1 | 8/2008 |
| WO | 2008/132228 | A1 | 11/2008 |
| WO | 2009/074491 | A1 | 6/2009 |
| WO | 2009/122982 | A1 | 10/2009 |
| WO | 2009/126106 | A1 | 10/2009 |
| WO | 2010/015726 | A1 | 2/2010 |
| WO | 2010/092239 | A1 | 8/2010 |
| WO | 2010/102802 | A1 | 9/2010 |
| WO | 2010/112519 | A1 | 10/2010 |
| WO | 2010/115785 | A1 | 10/2010 |
| WO | WO 2010/112519 | A1 | 10/2010 |
| WO | WO 2010/113805 | A1 | 10/2010 |
| WO | 2010/125247 | A2 | 11/2010 |
| WO | WO 2010/131016 | A2 | 11/2010 |
| WO | 2011/004300 | A1 | 1/2011 |
| WO | 2011/004301 | A1 | 1/2011 |
| WO | 2011/064441 | A1 | 6/2011 |
| WO | 2011/141877 | A1 | 11/2011 |
| WO | WO 2011/134939 | A1 | 11/2011 |
| WO | WO 2012/066308 | A2 | 5/2012 |
| WO | 2012/098296 | A2 | 7/2012 |
| WO | 2014/091212 | A1 | 6/2014 |

OTHER PUBLICATIONS

Office Action dated Oct. 28, 2015 in corresponding Japanese Patent Application No. 2013-539339.

Pauler, Nils, "Paper Optics", Lorentzen and Wettre, ISBN 91-071-765-6-7), pp. 29-36.

"Paper Coating Pigments", Tappi Monograph Series No. 30, 1966, pp. 34-35.

"Coated-paper producers look forward to brighter times", Pulp and Paper International, 1994, p. 18 et. seq.

Husband, J.C.; Gate, L. F.; Norouzi, N., and Blair, D., "The influence of kaolin shape factor on the stiffness of coated papers", Tappi Journal, pp. 12-17.

Husband, John C.; Preston, Janet S.; Gate, Len F.; Storer, Alistair; and Creaton, Peter, "The influence of pigment particle shape on the in-plane tensile strength properties of kaolin-based coating layers", Tappi Journal, vol. 5, No. 12, 2006, pp. 3-8.

Handbook of Pulp, Edited by Herbert Sixta, Wiley-VCH, 2006, pp. 41-42—XP 007918817.

Hubbe, Martin A.; Rojas, Orlando J.; Lucia, Lucian A.; and Sain, Mohini, "Cellulosic Nanocomposites: A Review", BioResources vol. 3, No. 3, 2008, pp. 929-980.

http://www.graymont.com/technical/Hydrated_Lime_More_Than_Just_Filler.pdf.

http://www4.ncsu.ed/~hubbe/Defnitns/Fibrilzn.htm.

Terao et al, "Pulp-Filler Interaction (3)—The Influence of Wet Pressing and Cellulosic Fines Addition on the Structure and Properties of Filler Loaded Papers," vol. 8 (1989) pp. 65-73.

Torvinen et al., "Flexible Filler—Nanocellulose Structures," VTT Technical Research Centre of Finland—1 page.

United Kingdom Search Report for UK Application No. GB0908401.3, dated Sep. 15, 2009, 4 pages.

U.S. Office Action dated Jan. 17, 2012 for U.S. Appl. No. 13/245,144, 15 pages.

Waterhouse, J .F., "Whither Refining?" Institute of Paper Science and Technology, No. 649 (1997) 40 pages.

Yano et al., "Production and Use of Machine Bio-Nano-Par φ," (2009) pp. 73-80.

Yano, Hiroyuki, "High Performance of Bio Fibers by the Addition of Filler," vol. 55, No. 4 (2009) pp. 63-68.

Yano, Hiroyuki, "Production and Use of Cellulose Nanofibers," Timber Financial Industrial Technology (2009) vol. 27, No. 1, pp. 14-22.

Zhao et al, "Ultrasonic Technique for Extracting Nanofibers from Nature Materials," Applied Physics Letters 90, 073112 (2007) 2 pages.

Zirconium Oxide Data sheet, downloaded on-line from www.stanfordmaterials.com, downloaded on Jan. 12, 2012, 7 pages.

Zirconium Silicate Data sheet, downloaded on-line from www.reade.com, downloaded on Jan. 12, 2012, 2 pages.

Zou and Hsieh, "Review of Microfibrillated Cellulose (MFC) for Papermaking," Pulp and Paper Engineering, School of Chemical and Biomolecular Eng., Georgia Institute of Technology, 10 pages.

Zou, Xuejun, "Production of Nanocrystalline Cellulose and its Potential Applications in Specialty Papers." Pira Specialty Papers Conference, Nov. 2010, pp. 1-30.

Australian Patent Examination Report No. 1 dated Feb. 26, 2014 for Australian Patent Application No. 2013202515, 3 pages.

Notice of Allowance for U.S. Appl. No. 14/843,516, dated Feb. 12, 2018, 8 pages.

Office Action for U.S. Appl. No. 14/843,516, dated Jun. 28, 2017, 11 pages.

Final Office Action for U.S. Appl. No. 14/843,516, dated Dec. 14, 2016, 18 pages.

Office Action for U.S. Appl. No. 14/843,516, dated Jan. 29, 2016, 10 pages.

Issue Notification for U.S. Appl. No. 12/994,356, dated Aug. 19, 2015, 1 page.

Issue Fee Payment for U.S. Appl. No. 12/994,356, dated Jul. 27, 2015, 3 pages.

Notice of Allowance for U.S. Appl. No. 12/994,356, dated Apr. 29, 2015, 7 pages.

Final Office Action for U.S. Appl. No. 12/994,356, dated Dec. 3, 2014, 12 pages.

Office Action for U.S. Appl. No. 12/994,356, dated Apr. 2, 2014, 13 pages.

Final Office Action for U.S. Appl. No. 12/994,356, dated Oct. 16, 2013, 14 pages.

(56) References Cited

OTHER PUBLICATIONS

Office Action for U.S. Appl. No. 12/994,356, dated Mar. 25, 2013, 12 pages.
Thorn et al., "Applications of Wet-End Paper Chemistry, Chapter 6, Fillers," Springer Science+ Business Media B.V. (2009) pp. 113-136.
Iwamoto, et al., "Nano-Fibrillation of Pulp Fibers for the Processing of Transparent Nanocomposites," Applied Physics A, vol. 89 (2007) pp. 461-466.
Iwamoto, et al., "Optically Transparent Composites Reinforced with Plant Fiber-Based Nanofibers," Applied Physics A, vol. 81 (2005) pp. 1109-1112.
Janardhnan and Sain, "Isolation of Cellulose Microfibrils—An Enzymatic Approach," BioResources, vol. 1, No. 2 (2006) pp. 176-188.
Japanese Final Office Action dated Jun. 10, 2016 from corresponding Japanese Patent Application No. 2014-133028, 8 pages.
Japanese Decision Final Rejection dated Feb. 21, 2017 from corresponding Japanese Patent Application No. 2014-133028, 8 pages.
Kang, Taegeun, "Role of External Fibrillation in Pulp and Paper Properties," Doctoral Thesis, Helsinki University of Technology, Laboratory of Paper and Printing Technology Reports, Series A28, Espoo 2007, 50 pages.
Klemm, et al., "Nanocelluloses as Innovative Polymers in Research and Application," Adv. Polymer Science, vol. 205 (2006) pp. 49-96.
Klungness, et al., "Fiber-Loading: A Progress Report," TAPPI Proceedings, 1994 Recycling Symposium, pp. 283-290.
Korean Office Action dated Jul. 29, 2016 for Korean Patent Application No. 10-2015-7030983, 16 pages.
Littunen, Kuisma, "Free Radical Graft Copolymerization of Microfibrillated Cellulose," Master's Thesis, Helsinki University of Technology, Sep. 2009, 83 pages.
Ioelovich and Figovsky, "Structure and Properties of Nanoparticles Used in Paper Compositions," Mechanics of Composite Materials, vol. 46, No. 4 (2010) pp. 435-442.
Ioelovich, Michael, "Structure and Properties of Nano-Particles Used in Paper Compositions," XXI TECNICELPA Conference and Exhibition/VI CIADICYP 2010, Portugal, 7 pages.
Ioelovich, Michael, "Cellulose as a Nanostructured Polymer: A Short Review," BioResources, vol. 3, No. 4 (2008) pp. 1403-1418.
Luukkanen, Lauri, "Reducing of Paper Porosity and Roughness Through Layered Structure," Aalto University School of Science and Technology, Master's thesis for the degree of Master of Science in Technology, Espoo, May 2010, 132 pages.
Mathur, V. "GRI's Fibrous Filler Technology Presentation to TAPPI", Philadelphia, PA (slides only), (2005) pp. 1-10.
Mill (grinding) http://en_wikipedia.org/w/index.php?title-File:Hammer_mill_open_front_full.jgp, 8 pgs.
Mori, et al., "Effect of Cellulose Nano-Fiber on Calcium Carbonate Crystal Form," Polymer Preprints, Japan, vol. 56, No. 2 (2007) 1 page.
Mörseburg and Chinga-Carrasco, "Assessing the Combined Benefits of Clay and Nanofibrillated Cellulose in Layered TMP-Based Sheets," Cellulose, vol. 16, (2009) pp. 795-806.
Mullite, 2001 [downloaded on-line Dec. 6, 2016], Mineral Data Publishing, 1 page.
Nakagaito and Yano, "The Effect of Fiber Content on the Mechanical and Thermal Expansion Properties of Biocomposites Based on Microfibrillated Cellulose," Cellulose, vol. 15 (2008) pp. 555-559.
Nakagaito, Antonio Norio, "Preparation of Bio Fiber and their Application", pp. 73-80.
OPTIFINER™ DF Deflakers, "Improved quality through effective deflaking." Stock Preparation and Recycled Fiber Systems, Metso Paper, (2006) 4 pages.
Pääkko et al., "Enzymatic Hydrolysis Combined with Mechanical Shearing and High-Pressure Homogenization for Nanoscale Cellulose Fibrils and Strong Gels," Biomacromolecules, vol. 8 (2007) pp. 1934-1941.
PCT International Preliminary Report on Patentability for PCT International Application No. PCT/GB2010/000982, dated Nov. 24, 2011, 11 pages.
PCT International Search Report and Written Opinion for International Application No. PCT/N02010/000184, dated Sep. 13, 2010, 14 pages.
PCT International Search Report and Written Opinion for PCT Application No. PCT/GB2010/000982, dated Jun. 1, 2011, 15 pages.
PCT International Preliminary Report on Patentability for PCT International Application No. PCT/GB2011/052181, dated May 21, 2013, 9 pages.
Peltola, Maarit, "Preparation of Microfibrillated Cellulose," Master of Science Thesis, Tampere University of Technology, May 2009, 98 pages.
Pinkney et al., "Microfibrillated Cellulose—A New Structural Material," Engineering Doctorate Conference (2012), University of Birmingham, 2 pages.
Pöhler, Tiina & Lappalainen, Timo & Tammelin, Tekla & Eronen, Paula & Hiekkataipale, Panu & Vehniäinen, Annikki & M. Koskinen, Timo. (2011). "Influence of fibrillation method on the character of nanofibrillated cellulose (NFC)," 2010 TAPPI International Conference on Nanotechnology for the Forest Product Industry, Dipoli Congress Centre, Espoo, Finland, Sep. 27-29, 2010, 22 pages.
Porubská, et al., "Homo- and Heteroflocculation of Papermaking Fines and Fillers," Colloids and Surfaces A: Physiochem. Eng. Aspects, Elsevier Science, vol. 210 (2002) pp. 223-230.
Preparation and Application of Cellulose Nano Fiber, pp. 14-22.
Product information for the Ultra-fine Friction Grinder "Supermasscolloider," retrieved 2014, 1 page.
Saito et al., "Homogeneous Suspensions of Individualized Microfibrils from TEMPO-Catalyzed Oxidation of Native Cellulose," Biomacromolecules, American Chemical Society, vol. 7, No. 6 (2006) pp. 1687-1691.
Selder et al., "Broke systems for LWC, MWC and HWC Papers", Voith Sulzer Paper Technology, 8 pages, Dec. 2011.
Silenius, Petri, "Improving the Combinations of Critical Properties and Process Parameters of Printing and Writing Papers and Paperboards by New Paper-Filling Methods," Helsinki University of Technology Laboratory of Paper Technology Reports, Series A 14, Espoo 2002, 168 pages.
Sinnott et al., "Slurry Flow in a Tower Mill," Seventh International Conference on CFD in the Minerals and Process Industries, CSIRO, Melbourne, Australia, Dec. 9-11, 2009, pp. 1-7.
Siró, István, "Microfibrillated Cellulose and New Nanocomposite Materials: A Review," Cellulose, vol. 17 (2010) pp. 459-494.
Sixta, Herbert, "Handbook of Pulp, vol. 1," Wiley-VCH (2006) pp. 41-42—XP 007918817.
Smook, Gary A., Handbook for Pulp and Paper Technologists, 2nd Edition, Chapter 13, (1992), Angus Wilde Publications, pp. 194-208.
Somboon et al., "Grit Segments in TMP Refining. Part 1: Operating Parameters and Pulp Quality," Appita Journal, vol. 62, No. 1 (2009) pp. 37-41.
Somboon et al., "Grit Segments in TMP Refining. Part 2: Potential for Energy Reduction," Appita Journal, vol. 62, No. 1 (2009) pp. 42-45 and 59.
Somboon, Phichit, "On the Application of Grits to Thermomechanical Pulp Refining," TKK Reports on Forest Products Technology, Series A7, Espoo 2009, 61 pages.
Spence et al., "The Effect of Chemical Composition on Microfibrillar Cellulose Films from Wood Pulps: Mechanical Processing and Physical Properties," BioResource Technology, vol. 101 (2010) pp. 5961-5968.
Subramanian et al., "Calcium Carbonate—Cellulose Fibre Composites; The Role of Pulp Refining," Paper Technology (2006) pp. 27-31.
Subramanian, Ramjee, "Engineering Fine Paper by Utilising the Structural Elements of the Raw Materials," Doctoral Thesis, TKK Reports in Department of Forest ProductsTechnology, Series A1, Espoo 2008, 65 pages.

(56) References Cited

OTHER PUBLICATIONS

Subramanian, Ramjee, "Engineering Fine Paper by Utilising the Structural Elements of the Raw Materials," Doctoral Dissertations, 2008 http://lib.tkk.fi/Diss/2008/isbn9789512295234/, 3 pages.
Syverud et al., "The Influence of Microfibrillated Cellulose, MFC, on Paper Strength and Surface Properties," pp. 1-32.
Taiwanese Office Action for Taiwanese Application No. 099115704, dated Jul. 14, 2014, 8 pages.
Taniguchi, Takashi, "New Films Produced from Microfibrillated Natural Fibres," Polymer International, vol. 47 (1998) pp. 291-294.
Australian Examination Report for corresponding Australian Application No. 2011330981, dated Oct. 12, 2014, 4 pages.
Australian Examination Report for corresponding Australian Application No. 2016202328, dated Mar. 16, 2017, 2 pages.
Canadian Office Action for corresponding Canadian Application No. 2817635, dated Jan. 9, 2018, 5 pages.
Chinese Office Action and Search Report for corresponding Chinese Application No. 201180054900.9, dated Oct. 10, 2014, 21 pages.
European Office Action for corresponding European Application No. 11791031.5, dated Jan. 22, 2016, 4 pages.
European Office Action for corresponding European Application No. 11791031.5, dated May 30, 2016, 3 pages.
European Extended Search Report for corresponding European Application No. 17187141.1, dated Nov. 20, 2017, 8 pages.
Japanese Final Rejection for corresponding Japanese Application No. 2013-539339, dated Feb. 21, 2017, 6 pages.
Japanese Office Action for corresponding Japanese Application No. 2017-124112, dated Feb. 13, 2018, 9 pages.
Korean Office Action for corresponding Korean Application No. 10-2013-7015511, dated Oct. 23, 2017, 20 pages.
Abe et al., "Obtaining Cellulose Nanofibers with a Uniform Width of 15 nm from Wood," Biomacromolecules, vol. 8, (2007) pp. 3276-3278.
Ahola, Susanna, "Properties and Interfacial Behaviour of Cellulose Nanofibrils.," Doctoral Thesis (2008) 82 pages.
Ankerfors and Lindström, "NanoCellulose Developments in Scandinavia," Paper and Coating Chemistry Symposium (PCCS), Jun. 2009, Hamilton, Canada, 43 pages.
Ankerfors, Mikael, "The manufacture of microfibrillated cellolose (MFC) its applications," Nanostructured cellulose and new cellulose derivatives seminar, Nov. 2006, pp. 1-40.
ATREX G-Series, Megatrex, "Technology for Reject Treatment and Recovery", 2 pages.
Australian Patent Examination Report dated Jul. 26, 2012 for Australian Patent Application No. 2010247184, 6 pages.
Berglund, et al., "Nanostructured Cellulose Products," Finnish-Swedish Wood Material Science Research Programme Opening Seminar, Apr. 2004, Helsinki, Finland, 28 pages.
Bhatnagar and Sain, "Processing of Cellulose Nanofiber-Reinforced Composites," Journal of Reinforced Plastics and Composites, vol. 24, No. 12, (2005) pp. 1259-1268.
Canadian Office Action dated Dec. 18, 2013 for Canadian Application No. 2,748,137, 2 pages.
Characterisation Newsletter, "Microfibrillated Cellulose", No. 5, Jan. 2009, pp. 1-2.
Chinese Office Action and Search Report dated Jan. 6, 2014 for Chinese Application No. 201080003690.6, 15 pages.
Chinese Office Action dated Sep. 5, 2017 for Chinese Patent Application No. 201510628033.5, 9 pages.
Chinese Office Action and Search Report dated Jan. 10, 2017 from corresponding Chinese Patent Application No. 201510628033.5, 17 pages.
Chinga-Carrasco and Syverud, "Computer-Assisted Quantification of the Multi-Scale Structure of Films Made of Nanofibrillated Cellulose," J. Nanopart Res. (2010) pp. 841-851.
Eichhorn, et al., "Review: Current International Research into Cellulose Nanofibres and Nanocomposites," Journal of Materials Science, vol. 45, No. 1, (2010) pp. 1-33.
Eriksen et al., "The Use of Microfibrillated Cellulose Produced from Kraft Pulp as Strength Enhancer in TMP Paper," Nordic Pulp and Paper Research Journal, vol. 23, No. 3, (2008) pp. 299-304.
European Third Party Observations Pursuant to Article 115(1)EPC concerning European Patent Application No. 10 727 476.3, issued Jul. 22, 2014, 18 pages.
European Extended European Search Report dated Jan. 15, 2013, for European Application No. 12189681.5, 5 pages.
European Office Action dated Feb. 6, 2014 for European Application No. 12 189 681.5-1308, 3 pages.
European Office Action dated Feb. 11, 2015 for European Patent Application No. 12189681.5, 5 pages.
European Office Action dated Mar. 7, 2014 for European Patent Application No. 10 727 476.3-1308, 5 pages.
European Office Action dated May 26, 2014 for European Patent Application No. 10 727 476.3-1308, 4 pages.
European Office Action dated Nov. 30, 2012 for European Patent Application No. 10 727 476.3-2124, 4 pages.
European Office Action dated Oct. 25, 2013 for European Patent Application No. 10 727 476.3-1308, 3 pages.
European Office Action dated Jul. 20, 2012 for European Patent Application No. 10727476.3, 4 pages.
Third Party Observations Pursuant to Article 115(1) EPC concerning European Patent Application No. 10727476.3, dated Apr. 17, 2013, 12 pages.
European Search Report dated Sep. 16, 2016 for European Patent Application No. 16153032.4, 8 pages.
European Office Action dated Sep. 4, 2017 for European Patent Application No. 16153032.4, 3 pages.
European Partial European Search Report of European Patent Application No. 16153032.4-1308, dated May 17, 2016, 7 pages.
European Third Party Observations Pursuant to Article 115(1)EPC concerning European Patent Application No. 12 189 681.5, issued Jul. 10, 2014, 15 pages.
Fukui, Yoshitaka, "Microfibrillated Cellulose," vol. 60, No. 24 (1985) pp. 5-12.
GL&V, The Atrex System at M-real Hallein Paper Mill in Austria, "Atrex is running well and saving us money!" 4 pages.
Henriksson, Marielle, "Cellulose Nanofibril Networks and Composites, Preparation, Structure and Properties," KTH Chemical Science and Engineering (2008) 60 pages.
Henriksson et al., "Cellulose Nanopaper Structures of High Toughness," Biomacromolecules, vol. 9 (2008) pp. 1579-1585.
Hentze, Hans-Peter, "From Nanocellulose Science Towards Applications," VTT—Technical Research Center of Finland, PulPaper 2010, Jun. 2010, Helsinki, pp. 1-24.
http://puu.tkk.fl/en/research/research_groups/chemical_pulping_and_wood_refinery/seminar_presentations/knuts_100609_laitoksen_sisainen_seminaariesitys.pdf;Knuts, M. SC. Aaro, "Process installation and optimization to refine and produce NFC materials." pp. 1-9.
Hubbe et al., "What Happens to Cellulosic Fibers During Papermaking and Recycling? A Review," BioResources, vol. 2, No. 4 (2007) pp. 739-788.
Hubbe et al., "Cellulosic Nanocomposites: A Review," BioResources vol. 3, No. 3 (2008) pp. 929-980.
Indian Office Action dated Jun. 12, 2017 for Indian Patent Application No. 1474/MUMNP/2011, 12 pages.
INNVENTIA—Processes for Nanocellulose, http://www.innventia.com/templates/STFIPage_ 9108.aspx, retrieved 2011, 1 page.
Phipps, Jonathan, "Choosing Fillers for Optimum Paper Properties: Understanding the Comprosies," Paper Technology vol. 42 No. 7, Sep. 2001, pp. 37-41.
European Notice of Opposition and corrected p. 1, against European Patent No. 2640893, dated May 18, 2018, 31 pages.
Crofton et al., "Dielectric Studies of Cellulose and Its Derivatives: 1. Acetylation of Cellulose," Polymer (1982) 23:1605-1608.
Esau, Katherine, "Chapter 4, Cell Wall," Anatomy of Seed Plants, 2nd Edition, (1977) pp. 43-48.
Fahn A., "Plant Anatomy Fourth Edition," (1990) pp. 32-39.
Fengel, D., "Ideas on the Ultrastructure Organization of the Cell Wall Components," J. Polymer Sci.: Part C, No. 36 (1971) pp. 383-392.

(56) References Cited

OTHER PUBLICATIONS

Fengel et al., "Chapter 4 Cellulose," Wood Chemistry, Ultrastructure, Reactions, (1983) pp. 6-105.
Frey-Wyssling and Mühlethaler, "The Fine Structure of Cellulose." Fortschritte der Chemie Organischer Naturstoffe (1951) pp. 1-27.
Hult et al., "Cellulose Fibril Aggregation—An Inherent Property of Kraft Pulps," Polymer 42 (2001) pp. 3309-3314.
Indian Office Action dated Aug. 27, 2018 for corresponding Indian Patent Application No. 981/MUMNP/2013, 7 pages.
Japanese Office Action for Japanese Patent Application No. 2016-243557, dated Nov. 21, 2017, 10 pages.
Korean Office Action for corresponding Korean Application No. 10-2013-7015511, dated Aug. 29, 2018, 8 pages.
McGinnis and Shafizadeh, "Chapter 1 Cellulose and Hemicellulose," Pulp and Paper: Chemistry and Chemical Technology, (1980) pp. 1-38.
McGraw-Hill, "Cell Walls (Plant)," Encyclopedia of Science and Technology, 5th edition, (1982), pp. 737-741.
Roberts, J.C., "Chapter 2, The Material of Paper," The Chemistry of Paper, RSC Paperbacks, 1996, pp. 11-25.
Roberts, J.C., "Chapter 4, The Material of Paper," The Chemistry of Paper, RSC Paperbacks, 1996, pp. 52-68.
Rowland and Roberts "The Nature of Accessible Surfaces in the Microstructure of Cotton Cellulose," Journal of Polymer Science: Part A-1, vol. 10, (1972) pp. 2447-2461.
Saito et al., "Cellulose Nanofibers Prepared by TEMPO-Mediated Oxidation of Native Cellulose," Biomacromolecules, (2007) 8:2485-2491.
Notice of Allowance for U.S. Appl. No. 14/843,516, dated May 30, 2018, 8 pages.
European Office Action for corresponding European Patent Application No. 17187141.1, dated Aug. 29, 2018, 5 pages.
Peng et al., "Drying Cellulose Nanofibrils: in Search of a Suitable Method," Cellulose 2011, 12 pages.

* cited by examiner

COMPOSITIONS

CROSS REFERENCE TO RELATED APPLICATIONS

This application is a continuation of now abandoned U.S. application Ser. No. 13/884,279, filed Jul. 10, 2013, which is a national stage entry under 35 U.S.C. § 371 from PCT International Application No. PCT/GB2011/052181, filed Nov. 9, 2011, which claims the benefit to and priority of Great Britain Application No. 1019288.8, filed Nov. 15, 2010, and Great Britain Application No. 1113559.7, filed Aug. 5, 2011, the subject matter of all of which is incorporated herein by reference.

FIELD OF THE INVENTION

The present invention relates to compositions, such as filled and coated papers, comprising microfibrillated cellulose and inorganic particulate material.

BACKGROUND OF THE INVENTION

Inorganic particulate materials, for example an alkaline earth metal carbonate (e.g. calcium carbonate) or kaolin, are used widely in a number of applications. These include the production of mineral containing compositions which may be used in paper manufacture, paper coating, or polymer composite production. In paper and polymer products such fillers are typically added to replace a portion of other more expensive components of the paper or polymer product. Fillers may also be added with an aim of modifying the physical, mechanical, and/or optical requirements of paper and polymer products. Clearly, the greater the amount of filler that can be included, the greater potential for cost savings. However, the amount of filler added and the associated cost saving must be balanced against the physical, mechanical and optical requirements of the final paper or polymer product. Thus, there is a continuing need for the development of fillers for paper or polymers which can be used at a high loading level without adversely effecting the physical, mechanical and/or optical requirements of paper products. There is also a need for the development of methods for preparing such fillers economically.

The present invention seeks to provide alternative and/or improved fillers for paper or polymer products which may be incorporated in the paper or polymer product at relatively high loading levels whilst maintaining or even improving the physical, mechanical and/or optical properties of the paper or polymer product. The present invention also seeks to provide an economical method for preparing such fillers. As such, the present inventors have surprisingly found that a filler comprising microfibrillated cellulose and an inorganic particulate material can be prepared by economical methods and can be loaded in paper or polymer products at relatively high levels whilst maintaining or even improving the physical, mechanical and/or optical properties of the final paper or polymer product.

Further, the present invention seeks to address the problem of preparing microfibrillated cellulose economically on an industrial scale. Current methods of microfibrillating cellulosic material require relatively high amounts of energy owing in part to the relatively high viscosity of the starting material and the microfibrillated product, and a commercially viable process for preparing microfibrillated cellulose on an industrial scale has hitherto before proved elusive.

SUMMARY OF THE INVENTION

According to a first aspect, the present invention is directed to an article comprising a paper product comprising a co-processed microfibrillated cellulose and inorganic particulate material composition and one or more functional coatings on the paper product.

According to a second aspect, the present invention is direct to a paper product comprising a co-processed microfibrillated cellulose and inorganic particulate material composition, wherein the paper product has: (i) a first tensile strength greater than a second tensile strength of the paper product devoid of the co-processed microfibrillated cellulose and inorganic particulate material composition; (ii) a first tear strength greater than a second tear strength of the paper product devoid of the co-processed microfibrillated cellulose and inorganic particulate material composition; and/or iii) a first burst strength greater than a second burst strength of the paper product devoid of the co-processed microfibrillated cellulose and inorganic particulate material composition; and/or iv) a first sheet light scattering coefficient greater than a second sheet light scattering coefficient of the paper product devoid of the co-processed microfibrillated cellulose and inorganic particulate material composition; and/or v) a first porosity less than a second porosity of the paper product devoid of the co-processed microfibrillated cellulose and inorganic particulate material composition; and/or vi) a first z-direction (internal bond) strength greater than a second z-direction (internal bond) strength of the paper product devoid of the co-processed microfibrillated cellulose and inorganic particulate material composition.

According to a third aspect, the present invention is directed to a coated paper product, wherein the coating comprises a co-processed microfibrillated cellulose and inorganic particulate material composition, and wherein the coated paper product has: i. a first gloss greater than a second gloss of the coated paper product comprising a coating composition devoid of the co-processed microfibrillated cellulose and inorganic particulate material composition: and/or ii. a first stiffness greater than a second stiffness of the coated paper product comprising a coating composition devoid of the co-processed microfibrillated cellulose and inorganic particulate material composition; and/or iii. a first barrier property which is improved compared to a second barrier property of the coated paper product comprising a coating composition devoid of the co-processed microfibrillated cellulose and inorganic particulate material composition.

According to a fourth aspect, the present invention is directed to a polymer composition comprising a co-processed microfibrillated cellulose and inorganic particulate material composition.

According to a fifth aspect, the present invention is directed to a papermaking composition comprising a co-processed microfibrillated cellulose and inorganic particulate material composition, wherein the papermaking composition has a first cationic demand lower than a second cationic demand of the papermaking composition devoid of the co-processed microfibrillated cellulose and inorganic particulate material composition.

According to a sixth aspect, the present invention is directed to a papermaking composition comprising a co-processed microfibrillated cellulose and inorganic particulate material composition, wherein the papermaking composition is substantially devoid of retention aids.

According to a seventh aspect, the present invention is directed to a paper product comprising a co-processed microfibrillated cellulose and inorganic particulate material composition, wherein the paper product has a first formation index lower than a second formation index of the paper product devoid of the co-processed microfibrillated cellulose and inorganic particulate material composition.

DETAILED DESCRIPTION OF THE INVENTION

As used herein, "co-processed microfibrillated cellulose and inorganic particulate material composition" refers to compositions produced by the processes for microfibrillating fibrous substrates comprising cellulose in the presence of an inorganic particulate material as described herein.

Unless otherwise stated, "functional coating" refers to a coating or coatings applied to the surface of a paper product to modify, enhance, upgrade and/or optimize one or more non-graphical properties of said paper product (i.e., properties primarily unrelated to the graphical properties of the paper). In embodiments, the functional coating is not one which comprises a co-processed microfibrillated cellulose and inorganic particulate material composition. For example, the functional coating may be a polymer, a metal, an aqueous composition, a liquid barrier layer or a printed electronics layer.

Paper Products

In certain embodiments, the paper products comprise a co-processed microfibrillated cellulose and inorganic particulate material composition incorporated into the paper pulp (e.g., In the paper base as a filler composition). For example, the paper products may comprise at least about 0.5 wt. %, at least about 5 wt. %, at least about 10 wt. %, at least about 15 wt. %, at least about 20 wt. %, at least about 25 wt. %, at least about 30 wt. %, or at least about 35 wt. % of a co-processed microfibrillated cellulose and inorganic particulate material composition, based on the total weight of the paper product. Generally, the paper products will comprise no more than about 50 wt. %. for example, no more than about 45 wt. %. or no more than about 40 wt. % of a co-processed microfibrillated cellulose and inorganic particulate material composition. In a particular embodiment, the paper product comprises from about 25% to about 35% wt. % of a co-processed microfibrillated cellulose and inorganic particulate material composition. The fibre content of the co-processed microfibrillated cellulose and inorganic particulate material composition may be at least about 2 wt. %, at least about 3 wt. %, at least about 4 wt. %, at least about 5 wt. %, at least about 6 wt. %, at least about 7 wt. %, at least about 8 wt. %, at least about 10 wt. %, at least about 11 wt. %, at least about 12 wt. %, at least about 13 wt. %, at least about 14 wt. % or at least about 15. wt. %. Generally, the fibre content of the co-processed microfibrillated cellulose and inorganic particulate material composition will be less than about 25 wt. %, for example, less than about 20 wt. %.

After co-processing to form the co-processed microfibrillated cellulose and inorganic particulate material composition, additional inorganic particulate may be added (e.g., by blending or mixing) to reduce the fibre content of the co-processed microfibrillated cellulose and inorganic particulate material composition.

In particular embodiments, the paper products comprising a co-processed microfibrillated cellulose and inorganic particulate material composition have a lower porosity as compared to the paper products produced without (i.e., devoid of) the co-processed microfibrillated cellulose and inorganic particulate material composition. For instance, the porosity of the paper products comprising a co-processed microfibrillated cellulose and inorganic particulate material composition may have a porosity about 10% less porous, about 20% less porous, about 30% less porous, about 40% less porous, or about 50% less porous than a porosity of the paper products devoid of the co-processed microfibrillated cellulose and inorganic particulate material composition. Such a reduction in porosity may provide improved coating hold-out for coated paper products comprising a co-processed microfibrillated cellulose and inorganic particulate material. Such a reduction in porosity may enable a reduction in coat weight for coated paper products comprising a co-processed microfibrillated cellulose and inorganic particulate material without compromising the physical and/or mechanical properties of the coated paper product.

In an embodiment, porosity is determined using a Bendtsen Model 5 porosity tester in accordance with SCAN P21, SCAN P60, BS 4420 and Tappi UM 535.

In other embodiments, the paper products comprising a co-processed microfibrillated cellulose and inorganic particulate material composition have a tensile strength about 2% greater, about 5% greater, about 10% greater, about 15% greater, about 20% greater, or about 25% greater than a tensile strength of the paper products devoid of a co-processed microfibrillated cellulose and inorganic particulate material composition (e.g., the paper product has the same filler loading).

In further embodiments, the paper products comprising a co-processed microfibrillated cellulose and inorganic particulate material composition have a tear strength about 2% greater, about 5% greater, about 10% greater, about 15% greater, about 20% greater, or about 25% greater than a tear strength of the paper products devoid of a co-processed microfibrillated cellulose and inorganic particulate material composition (e.g., the paper product has the same filler loading). Such low porosity, strong paper products may comprise functional papers such as gaskets, grease proof papers, linerboard for plasterboard, flame retardant papers, wall papers, laminates, or other functional paper products.

In an embodiment, tensile strength is determined using a Testometrics tensile tester according to SCAN P16.

In further embodiments, the paper products comprising a co-processed microfibrillated cellulose and inorganic particulate material composition have a z-direction (internal bond) strength about 2% greater, about 5% greater, about 10% greater, about 15% greater, about 20% greater, or about 25% greater than a z-direction (internal bond) strength of the paper products devoid of a co-processed microfibrillated cellulose and inorganic particulate material composition (e.g., the paper product has the same filler loading).

In an embodiment, z-direction (internal bond) strength is determined using a Scott bond tester according to TAPPI T569.

In certain embodiments, the paper products comprising a co-processed microfibrillated cellulose and inorganic particulate material composition may be coated. Particular embodiments of the coated paper products comprising a co-processed microfibrillated cellulose and inorganic particulate material composition may have an increased gloss as compared to the coated paper product devoid of the co-processed microfibrillated cellulose and inorganic particulate material composition. For example, the coated paper products comprising a co-processed microfibrillated cellulose and inorganic particulate material composition may have a gloss about 5% greater, about 10% greater, or about 20% greater than the coated paper products devoid of the co-processed microfibrillated cellulose and inorganic particulate material composition.

In an embodiment, gloss is determined in accordance with TAPPI method T 480 om-05 (Specular gloss of paper and paperboard at 75 degrees).

In other embodiments, the coated paper products comprising a co-processed microfibrillated cellulose and inorganic particulate material composition may have improved print properties such as print gloss, snap, print density, picking speed or percent missing dots.

In other embodiments, the coated paper products comprising a co-processed microfibrillated cellulose and inorganic particulate material composition may have a lower moisture vapour transmission rate (MVTR, tested in accordance with a modified version of TAPPI T448 using silica gel as the desiccant and a relative humidity of 50%) as compared to the coated paper product devoid of the co-processed microfibrillated cellulose and inorganic particulate material composition. For example, the coated paper products comprising a co-processed microfibrillated cellulose and inorganic particulate material composition may have a MVTR about 2% less, about 4% less, about 6% less, about 8% less, about 10% less, about 12% less, about 15% less, or about 20% less than the coated paper products devoid of the co-processed microfibrillated cellulose and inorganic particulate material composition (e.g., the coated paper product has the same filler loading).

In certain embodiments, the paper products comprising a co-processed microfibrillated cellulose and inorganic particulate material composition may serve as a base for functional coatings such as coatings for liquid packaging, barrier coatings, and coatings for printed electronics. The paper products comprising a co-processed microfibrillated cellulose and inorganic particulate material composition provide a smooth surface for the functional coatings to be applied on. For example, the paper products may include a barrier coating comprising a polymer, a metal, an aqueous composition (e.g., a water-based barrier layer), or a combination thereof.

The aqueous composition may comprise one or more of the inorganic particulate materials described herein. For example, the aqueous composition may comprise kaolin, such as platy kaolin or hyper-platy kaolin. By 'platy' kaolin is meant kaolin a kaolin product having a high shape factor. A platy kaolin has a shape factor from about 20 to less than about 60. A hyper-platy kaolin has a shape factor from about 60 to 100 or even greater than 100. "Shape factor", as used herein, is a measure of the ratio of particle diameter to particle thickness for a population of particles of varying size and shape as measured using the electrical conductivity methods, apparatuses, and equations described in U.S. Pat. No. 5,576,617, which is incorporated herein by reference. As the technique for determining shape factor is further described in the '617 patent the electrical conductivity of a composition of an aqueous suspension of orientated particles under test is measured as the composition flows through a vessel. Measurements of the electrical conductivity are taken along one direction of the vessel and along another direction of the vessel transverse to the first direction. Using the difference between the two conductivity measurements, the shape factor of the particulate material under test is determined.

In some embodiments, the paper products comprising a co-processed microfibrillated cellulose and inorganic particulate material composition provide a low permeability surface for application of the functional coatings such that there is little or no penetration of the functional coating into the paper product. Thus, thinner, fewer, and/or non-polymeric functional coatings might be used to achieve a desired function (e.g., barrier function). In certain embodiments, the coated papers products comprising a co-processed microfibrillated cellulose and inorganic particulate material composition may have improved oil resistance (as measured using an oil based-solution of Sudan Red IV in dibutyl phthalate using an IGT printing unit) as compared to the coated paper product devoid of the co-processed microfibrillated cellulose and inorganic particulate material composition. For example, the coated paper products comprising a co-processed microfibrillated cellulose and inorganic particulate material composition may have an oil resistance which is about 2% greater, about 4% greater, about 6% greater, about 8% greater, or about 10% greater than the coated paper products devoid of the co-processed microfibrillated cellulose and inorganic particulate material composition (e.g., the coated paper product has the same filler loading).

Improved Paper Making and Sheet Properties

In some embodiments, the paper products comprising a co-processed microfibrillated cellulose and inorganic particulate material composition allow for improved processes for making such paper products. For instance, by including a co-processed microfibrillated cellulose and inorganic particulate material composition in the paper furnish, the wet end processing of the paper base may not require pretreatment (e.g., addition of cationic polymers). In addition, as compared to a paper furnish including microfibrillated cellulose, a paper furnish including a co-processed microfibrillated cellulose and inorganic particulate material composition has lower or no change in cationic demand, improved retention, and improved formation. In some embodiments in which retention is improved by the co-processed microfibrillated cellulose and inorganic particulate material composition used in the paper product, use of retention aids may be reduced or eliminated and damage to the paper products resulting from the retention aids may be avoided.

Cationic demand of a sample of papermaking furnish is indicated by the amount of highly charged cationic polymer required to neutralize its surface. A streaming current test may be used to determine cationic demand, based on the amount of cationic titrant (e.g., poly-DADMAC) required to reach a zero signal. Another way to determine the endpoint is by evaluating the zeta potential after each incremental addition of titrant. Another strategy for determining cationic demand is to mix the sample with a known excess of cationic titrant, filter to remove the solids, and then back-titrate to a color endpoint (colloidal titration). In embodiments, the cationic demand of a papermaking furnish comprising the co-processed microfibrillated cellulose and inorganic particulate material composition is comparable to or less than the cationic demand of a papermaking furnish devoid of the co-processed microfibrillated cellulose and inorganic particulate material composition (e.g., the paper furnish has the same filler loading).

In an embodiment, cationic demand (also known as 'anionic charge') is measured using a Mutek PCD 03 Titrator in accordance with the method described below in the 'Examples'.

Retention is a general term for the process of keeping fine particles and fibre fines within the web of paper as it is being formed. First-pass retention gives a practical indication of the efficiency by which these fine materials are retained in the web of paper as it is being formed. In certain embodiments, the first-pass retention of a paper furnish comprising the co-processed microfibrillated cellulose and inorganic particulate material composition is greater, for example, at least about 2% greater, about 5% greater, or about 10% greater than a paper furnish devoid of the co-processed microfibrillated cellulose and inorganic particulate material composition (e.g., the paper furnish has the same filler loading).

In an embodiment, first-pass retention is determined on the basis of the solids measurement in the headbox (HD) and in the white water (WW) tray and is calculated according to the following formula:

$$\text{Retention}=[(HB_{solids}-WW_{solids})/HB_{solids}]\times 100$$

Ash retention (as determined by incineration) during paper formation may be improved in paper products formed from a paper furnish comprising the co-processed microfibrillated cellulose and inorganic particulate material composition compared to a paper furnish devoid of the co-processed microfibrillated cellulose and inorganic particulate material composition (e.g., the paper furnish has the same filler loading). In embodiments, as retention during paper formation formed from a paper furnish comprising the co-processed microfibrillated cellulose and inorganic particulate material composition is at least about 5%, at least about 10%, at least about 15%, at least about 20%, or at least about 25% greater than a paper furnish devoid of the co-processed microfibrillated cellulose and inorganic particulate material composition (e.g., the paper furnish has the same filler loading).

In an embodiment, ash retention is determined following the same principles as first-pass retention, but based on the weight of the ash component in the headbox (HB) and in the white water (WW) tray, and is calculated according to the following formula:

$$\text{Ash retention}=[(HB_{ash}-WW_{ash})/HB_{ash}]\times 100$$

Paper formation is the resulting non-uniform distribution of fibers, fiber fragments, mineral fillers, and chemical additives on the paper forming web. Formation may be characterized by the small-scale basis weight variation in the plane of the paper sheet. Another way of describing formation is the variability of the basis weight of paper. The uneven structure of paper may be seen with the naked eye at length scales ranging from fractions of a millimeter to a few centimeters. In certain embodiments, the formation index (PTS) of a paper furnish comprising the co-processed microfibrillated cellulose and inorganic particulate material composition is at least about 5% less, about 10% less, about 15% less, about 20%, or about 25% less than a paper furnish devoid of the co-processed microfibrillated cellulose and inorganic particulate material composition (e.g., the paper furnish has the same filler loading).

In an embodiment, formation index (PTS) is determined using the DOMAS software developed by PTS in accordance with the measurement method described in section 10-1 of their handbook, 'DOMAS 2.4 User Guide'.

In other embodiments, a paper board product comprising a co-processed microfibrillated cellulose and inorganic particulate material composition may have improved foldability and/or crack resistance.

Paper products comprising a co-processed microfibrillated cellulose and inorganic particulate material composition also may have a combination of improved sheet properties. For example, the paper product sheets comprising a co-processed microfibrillated cellulose and inorganic particulate material composition have improved strength properties and improved formation. Without being bound by a particular theory, such a combination is surprising because it is believed that additional refining or fibrillation undesirably damages paper formation due to reduced stability that leads to a propensity to flocculate, but may increase paper sheet strength.

In other embodiments, the paper product sheets comprising a co-processed microfibrillated cellulose and inorganic particulate material composition have improved tensile strength, tear strength and z-direction strength (internal bond). This is surprising since normally in pulp refining, as tensile strength increases, tear strength and/or z-directional strength will decrease. For example, paper product sheets comprising a co-processed microfibrillated cellulose and inorganic particulate material composition may have a tensile strength which is at least about 2% greater, at least about 3% greater, at least about 4% greater, at least about 5% greater, at least about 6% greater, at least about 7% greater, at least about 8% greater, at least about 9%, at least about 10% greater, at least about 12% greater, at least about 15% greater, or at least about 20% greater than paper product sheets devoid of the co-processed microfibrillated cellulose and inorganic particulate material composition (e.g., the paper product sheet has the same filler loading). In other embodiments, paper product sheets comprising a co-processed microfibrillated cellulose and inorganic particulate material composition may have a tear strength which is at least about 5% greater, at least about 10% greater, at least about 15% greater, at least about 20% greater, or at least about 25% greater than paper product sheets devoid of the co-processed microfibrillated cellulose and inorganic particulate material composition (e.g., the paper product sheet has the same filler loading). In other embodiments the paper product sheets comprising a co-processed microfibrillated cellulose and inorganic particulate material composition have a combination of improved tensile strength and improved tear strength. For example, paper product sheets comprising a co-processed microfibrillated cellulose and inorganic particulate material composition may have a tensile strength which is from about 2% to about 10% greater than paper product sheets devoid of the co-processed microfibrillated cellulose and inorganic particulate material composition, and a tear strength from about 5% to about 25% greater than paper product sheets devoid of the co-processed microfibrillated cellulose and inorganic particulate material composition.

In an embodiment, tear strength is determined in accordance with TAPPI method T 414 om-04 (Internal tearing resistance of paper (Elmendorf-type method).

In other embodiments, the paper product sheets comprising a co-processed microfibrillated cellulose and inorganic particulate material composition have improved tensile strength and improved scatter (i.e., optical) properties, e.g., sheet light scattering and sheet light absorption. Again, this is surprising since normally, as tensile strength increases, sheet light scatter decreases. In certain embodiments the paper product sheets comprising a co-processed microfibrillated cellulose and inorganic particulate material composition may have a sheet light scattering coefficient (in $m^2\ kg^{-1}$, measured using filters 8 and 10) which is at least about 2% greater, at least about 3% greater, at least about 4% greater, at least about 5% greater, at least about 6% greater, at least about 7% greater, at least about 8% greater, at least about 9% greater, or at least about 10% greater than paper product sheets devoid of the co-processed microfibrillated cellulose and inorganic particulate material composition (e.g., the paper product sheet has the same filler loading). In other embodiments the paper product sheets comprising a co-processed microfibrillated cellulose and inorganic particulate material composition have a combination of improved tensile strength and/or improved tear strength, and improved light scattering. For example, paper product sheets comprising a co-processed microfibrillated cellulose and inorganic particulate material composition may have a tensile strength which is from about 2% to about 10% greater than paper product sheets devoid of the co-processed microfibrillated cellulose and inorganic particulate material composition, and/or a tear strength from about 5% to about 25% greater than paper product sheets devoid of the co-processed microfibrillated cellulose and inorganic particulate material composition, and a sheet light scattering coefficient (in $m^2 kg^{-1}$, measured using filters 8 and 10) which is from about 2% to about 10% greater, for example, from about 2% to about 5% greater than paper product sheets devoid of the co-processed microfibrillated cellulose and inorganic particulate material composition (e.g., the paper product sheet has the same filler loading).

In an embodiment, sheet light scattering and absorption coefficients are measured using reflectance data from an Elrepho instrument: R inf=reflectance of stack of 10 sheets, Ro=reflectance of 1 sheet over a black cup, and these values and the substance ($gm^{-2}$) of the sheet are inputted into the Kubelka-Munk equations described in "Paper Optics" by Nils Pauler, (published by Lorentzen and Wettre, ISBN 91-971-765-6-7), p. 29-36.

Bursting strength is widely used as a measure of resistance to rupture in many kinds of paper. In certain embodiments, the paper product sheets comprising a co-processed microfibrillated cellulose and inorganic particulate material composition may have a burst strength which is at least about 5% greater, at least about 10% greater, at least about 15% greater, at least about 20% greater, or at least about 25% greater than paper product sheets devoid of the co-processed microfibrillated cellulose and inorganic particulate material composition (e.g., the paper product sheet has the same filler loading).

In an embodiment, Burst Strength is determined using a Messemer Büchnel burst tester according to SCAN P 24.

In certain embodiments, such improved paper product sheet properties may be achieved in paper product sheets comprising a co-processed microfibrillated cellulose and inorganic particulate material composition including microfibrillated cellulose having a $d_{50}$ ranging from about 25 μm to about 250 μm, more preferably from about 30 μm to about 150 μm, even more preferably from about 50 μm to about 140 μm, still more preferably from about 70 μm to about 130 μm, and most preferably from about 50 μm to about 120 μm. In particular embodiments, the microfibrillated cellulose of the co-processed microfibrillated cellulose and inorganic particulate material composition has a high steepness (as defined below) directed towards a desired $d_{50}$. In one embodiment, a steep particle size distribution of the microfibrillated cellulose may be produced by microfibrillation of the fibrous substrate comprising cellulose in the presence of the inorganic particulate material in a batch process in which the resulting co-processed microfibrillated cellulose and inorganic particulate material composition having the desired microfibrillated cellulose steepeness may be washed out of the microfibrillation apparatus with water or any other liquid.

In certain embodiments, the microfibrillated cellulose of the co-processed microfibrillated cellulose and inorganic particulate material composition has a monomodal particle size distribution. In other embodiments, the microfibrillated cellulose of the co-processed microfibrillated cellulose and inorganic particulate material composition has a multimodal particle size distribution produced by, for example, less or partial microfibrillation of the fibrous substrate comprising cellulose in the presence of the inorganic particulate material.

Coatings

In certain embodiments, the coatings may comprise a co-processed microfibrillated cellulose and inorganic particulate material composition. The coatings comprising a co-processed microfibrillated cellulose and inorganic particulate material composition may also be used as functional papers such as those used for liquid packaging, barrier coatings, or printed electronics applications. For example, the functional coating may be a barrier layer, e.g., a liquid barrier layer, or the functional coating may be a printed electronics layer.

The coating comprising a co-processed microfibrillated cellulose and inorganic particulate material composition may be applied to a paper product to produce a paper product or paper coating having greater strength properties (e.g., tensile strength, tear strength and stiffness), greater gloss, and/or improved print properties (e.g., print gloss, snap, print density, or percent missing dots). For example, the paper product coated with a coating comprising a co-processed microfibrillated cellulose and inorganic particulate material composition may have a tensile strength about 5% greater, about 10% greater, or about 20% greater than a tensile strength of the paper product coated with a coating devoid of a co-processed microfibrillated cellulose and inorganic particulate material composition. In certain embodiments, the paper product coated with a coating comprising a co-processed microfibrillated cellulose and inorganic particulate material composition may have a tear strength about 5% greater, about 10% greater, or about 20% greater than a tear strength of the paper product coated with a coating devoid of a co-processed microfibrillated cellulose and inorganic particulate material composition. In certain embodiments, the paper product coated with a coating comprising a co-processed microfibrillated cellulose and inorganic particulate material composition may have a stiffness about 5% greater, about 10% greater, or about 20% greater than a stiffness of the paper product coated with a coating devoid of a co-processed microfibrillated cellulose and inorganic particulate material composition. In some embodiments, the paper product coated with a coating comprising a co-processed microfibrillated cellulose and inorganic particulate material composition may have a gloss about 5% greater, about 10% greater, or about 20% greater than a gloss of the paper product coated with a coating devoid of a co-processed microfibrillated cellulose and inorganic particulate material composition. In some embodiments, the paper product coated with a coating comprising a co-processed microfibrillated cellulose and inorganic particulate material composition may have a barrier property which is improved compared to barrier property of the paper product coated with a coating devoid of a co-processed microfibrillated cellulose and inorganic particulate material composition. The barrier property may be selected from the rate at which one or more of oxygen, moisture, grease and aromas pass (i.e., transmitted) pass through the coated paper product. The coating comprising a co-processed microfibrillated cellulose and inorganic particulate material composition may therefore slow down or ameliorate (i.e., decrease) the rate at which one or more of oxygen, moisture, grease and aromas pass through the coated paper product.

In embodiments, tensile strength, tear strength and gloss are determined in accordance with the methods described above.

In embodiments, stiffness (i.e., elastic modulus) is determined in accordance with the stiffness measurement method described in J. C. Husband, L. F. Gate, N. Norouzi, and D. Blair, "The Influence of kaolin Shape Factor on the Stiffness of Coated Papers", TAPPI Journal, June 2009, p. 12-17 (see in particular the section entitled 'Experimental Methods'); and J. C. Husband, J. S. Preston, L. F. Gate, A. Storer, and P. Creaton, "The Influence of Pigment Particle Shape on the In-Plane tensile Strength Properties of Kaolin-based Coating Layers", TAPPI Journal, December 2006, p. 3-8 (see in particular the section entitled 'Experimental Methods').

In an embodiment, the inorganic particulate material is kaolin. Advantageously, the kaolin is a platy kaolin or a hyper-play kaolin.

Dispersible Compositions

In certain embodiments, the co-processed microfibrillated cellulose and inorganic particulate material composition may be in the form of a dry or substantially dry, re-dispersable composition, as produced by the processes described herein or by any other drying process known in the art (e.g., freeze-drying). The dried co-processed microfibrillated cellulose and inorganic particulate material composition may be easily dispersed in aqueous or non-aqueous medium (e.g., polymers).

Thus, in accordance with the third aspect of the present invention, there is provided a polymer composition comprising the co-processed microfibrillated cellulose and inorganic particulate material composition described herein.

The polymer composition may comprise at least about 0.5 wt. %, at least about 5 wt. %, at least about 10 wt. %, at least about 15 wt. %, at least about 20 wt. %, at least about 25 wt. %, at least about 30 wt. %, or at least about 35 wt. % of a co-processed microfibrillated cellulose and inorganic particulate material composition, based on the total weight of the polymer composition. Generally, the polymer will comprise no more than about 50 wt. %, for example, no more than about 45 wt. %, or no more than about 40 wt. % of a co-processed microfibrillated cellulose and inorganic particulate material composition. In a particular embodiment, the polymer composition comprises from about 25% to about 35% wt. % of a co-processed microfibrillated cellulose and inorganic particulate material composition. The fibre content of the co-processed microfibrillated cellulose and inorganic particulate material composition may be at least about 2 wt. %, at least about 3 wt. %, at least about 4 wt. %, at least about 5 wt. %, at least about 6 wt. %, at least about 7 wt. %, at least about 8 wt. %, at least about 10 wt. %, at least about 11 wt. %, at least about 12 wt. %, at least about 13 wt. %, at least about 14 wt. % or at least about 15, wt. %. Generally, the fibre content of the co-processed microfibrillated cellulose and inorganic particulate material composition will be less than about 25 wt. %, for example, less than about 20 wt. %.

The polymer may comprise any natural or synthetic polymer or mixture thereof. The polymer may, for example, be thermoplastic or thermoset. The term "polymer" used herein includes homopolymers and/or copolymers, as well as crosslinked and/or entangled polymers.

Polymers, including homopolymers and/or copolymers, comprised in the polymer composition of the present invention may be prepared from one or more of the following monomers: acrylic acid, methacrylic acid, methyl methacrylate, and alkyl acrylates having 1-18 carbon atoms in the alkyl group, styrene, substituted styrenes, divinyl benzene, diallyl phthalate, butadiene, vinyl acetate, acrylonitrile, methacrylonitrile, maleic anhydride, esters of maleic acid or fumaric acid, tetrahydrophthalic acid or anhydride, itaconic acid or anhydride, and esters of itaconic acid, with or without a cross-linking dimer, trimer, or tetramer, crotonic acid, neopentyl glycol, propylene glycol, butanediols, ethylene glycol, diethylene glycol, dipropylene glycol, glycerol, cyclohexanedimethanol, 1,6 hexanediol, trimethylolpropane, pentaerythritol, phthalic anhydride, isophthalic acid, terephthalic acid, hexahydrophthalic anhydride, adipic acid or succinic acids, azelaic acid and dimer fatty acids, toluene diisocyanate and diphenyl methane diisocyanate. Copolymers comprising methyl methacrylate and styrene monomers are preferred.

The polymer may be selected from one or more of polymethylmethacrylate (PMMA), polyacetal, polycarbonate, polyacrylonitrile, polybutadiene, polystyrene, polyacrylate, polypropylene, epoxy polymers, unsaturated polyesters, polyurethanes, polycyclopentadienes and copolymers thereof. Suitable polymers also include liquid rubbers, such as silicones.

Preparation of the polymer compositions of the present invention can be accomplished by any suitable mixing method known in the art, as will be readily apparent to one of ordinary skill in the art.

Such methods include blending of the individual components or precursors thereof and subsequent processing in a conventional manner. Certain of the ingredients can, if desired, be pre-mixed before addition to the compounding mixture.

In the case of thermoplastic polymer compositions, such processing may comprise melt mixing, either directly in an extruder for making an article from the composition, or pre-mixing in a separate mixing apparatus. Dry blends of the individual components can alternatively be directly injection moulded without pre-melt mixing.

The polymer composition can be prepared by mixing of the components thereof intimately together. The said co-processed microfibrillated cellulose and inorganic particulate material composition may then be suitably blended with the polymer and any desired additional components, before processing as described above.

For the preparation of cross-linked or cured polymer compositions, the blend of uncured components or their precursors, and, if desired, the co-processed microfibrillated cellulose and inorganic particulate material composition and any desired non-perlite component(s), will be contacted under suitable conditions of heat, pressure and/or light with an effective amount of any suitable cross-linking agent or curing system, according to the nature and amount of the polymer used, in order to cross-link and/or cure the polymer.

For the preparation of polymer compositions where the co-processed microfibrillated cellulose and inorganic particulate material composition and any desired other component(s) are present in situ at the time of polymerisation, the blend of monomer(s) and any desired other polymer precursors, co-processed microfibrillated cellulose and inorganic particulate material composition and any other component(s) will be contacted under suitable conditions of heat, pressure and/or light, according to the nature and amount of the monomer(s) used, in order to polymerise the monomer(s) with the perlite and any other component(s) in situ.

The Fibrous Substrate Comprising Cellulose

The fibrous substrate comprising cellulose may be derived from any suitable source, such as wood, grasses (e.g., sugarcane, bamboo) or rags (e.g., textile waste, cotton, hemp or flax). The fibrous substrate comprising cellulose may be in the form of a pulp (i.e., a suspension of cellulose fibres in water), which may be prepared by any suitable chemical or mechanical treatment, or combination thereof. For example, the pulp may be a chemical pulp, or a chemithermomechanical pulp, or a mechanical pulp, or a recycled pulp, or a papermill broke, or a papermill waste stream, or waste from a papermill, or a combination thereof. The cellulose pulp may be beaten (for example in a Valley beater) and/or otherwise refined (for example, processing in a conical or plate refiner) to any predetermined freeness, reported in the art as Canadian standard freeness (CSF) in $cm^3$. CSF means a value for the freeness or drainage rate of pulp measured by the rate that a suspension of pulp may be drained. For example, the cellulose pulp may have a Canadian standard freeness of about 10 $cm^3$ or greater prior to being microfibrillated. The cellulose pulp may have a CSF of about 700 $cm^3$ or less, for example, equal to or less than about 650 $cm^3$, or equal to or less than about 600 $cm^3$, or equal to or less than about 550 $cm^3$, or equal to or less than about 500 $cm^3$, or equal to or less than about 450 $cm^3$, or equal to or less than about 400 $cm^3$, or equal to or less than about 350 $cm^3$, or equal to or less than about 300 $cm^3$, or equal to or less than about 250 $cm^3$, or equal to or less than about 200 $cm^3$, or equal to or less than about 150 $cm^3$, or equal to or less than about 100 $cm^3$, or equal to or less than about 50 $cm^3$. The cellulose pulp may then be dewatered by methods well known in the art, for example, the pulp may be filtered through a screen in order to obtain a wet sheet comprising at least about 10% solids, for example at least about 15% solids, or at least about 20% solids, or at least about 30% solids, or at least about 40% solids. The pulp may be utilised in an unrefined state, that is to say without being beaten or dewatered, or otherwise refined.

The fibrous substrate comprising cellulose may be added to a grinding vessel or homogenizer in a dry state. For example, a dry paper broke may be added directly to the grinder vessel. The aqueous environment in the grinder vessel will then facilitate the formation of a pulp.

The Inorganic Particulate Material

The inorganic particulate material may, for example, be an alkaline earth metal carbonate or sulphate, such as calcium carbonate, magnesium carbonate, dolomite, gypsum, a hydrous kandite clay such as kaolin, halloysite or ball clay, an anhydrous (calcined) kandite clay such as metakaolin or fully calcined kaolin, talc, mica, huntite, hydromagnesite, ground glass, perlite or diatomaceous earth, or magnesium hydroxide, or aluminium trihydrate, or combinations thereof.

A preferred inorganic particulate material for use in the method according to the first aspect of the present invention is calcium carbonate. Hereafter, the invention may tend to be discussed in terms of calcium carbonate, and in relation to aspects where the calcium carbonate is processed and/or treated. The invention should not be construed as being limited to such embodiments.

The particulate calcium carbonate used in the present invention may be obtained from a natural source by grinding. Ground calcium carbonate (GCC) is typically obtained by crushing and then grinding a mineral source such as chalk, marble or limestone, which may be followed by a particle size classification step, in order to obtain a product having the desired degree of fineness. Other techniques such as bleaching, flotation and magnetic separation may also be used to obtain a product having the desired degree of fineness and/or colour. The particulate solid material may be ground autogenously, i.e. by attrition between the particles of the solid material themselves, or, alternatively, in the presence of a particulate grinding medium comprising particles of a different material from the calcium carbonate to be ground. These processes may be carried out with or without the presence of a dispersant and biocides, which may be added at any stage of the process.

Precipitated calcium carbonate (PCC) may be used as the source of particulate calcium carbonate in the present invention, and may be produced by any of the known methods available in the art. TAPPI Monograph Series No 30, "Paper Coating Pigments", pages 34-35 describes the three main commercial processes for preparing precipitated calcium carbonate which is suitable for use in preparing products for use in the paper industry, but may also be used in the practice of the present invention. In all three processes, a calcium carbonate feed material, such as limestone, is first calcined to produce quicklime, and the quicklime is then slaked in water to yield calcium hydroxide or milk of lime. In the first process, the milk of lime is directly carbonated with carbon dioxide gas. This process has the advantage that no by-product is formed, and it is relatively easy to control the properties and purity of the calcium carbonate product. In the second process the milk of lime is contacted with soda ash to produce, by double decomposition, a precipitate of calcium carbonate and a solution of sodium hydroxide. The sodium hydroxide may be substantially completely separated from the calcium carbonate if this process is used commercially. In the third main commercial process the milk of lime is first contacted with ammonium chloride to give a calcium chloride solution and ammonia gas. The calcium chloride solution is then contacted with soda ash to produce by double decomposition precipitated calcium carbonate and a solution of sodium chloride. The crystals can be produced in a variety of different shapes and sizes, depending on the specific reaction process that is used. The three main forms of PCC crystals are aragonite, rhombohedral and scalenohedral (e.g., calcite), all of which are suitable for use in the present invention, including mixtures thereof.

Wet grinding of calcium carbonate involves the formation of an aqueous suspension of the calcium carbonate which may then be ground, optionally in the presence of a suitable dispersing agent. Reference may be made to, for example, EP-A-614948 (the contents of which are incorporated by reference in their entirety) for more information regarding the wet grinding of calcium carbonate.

In some circumstances, minor additions of other minerals may be included, for example, one or more of kaolin, calcined kaolin, wollastonite, bauxite, talc or mica, could also be present.

When the inorganic particulate material of the present invention is obtained from naturally occurring sources, it may be that some mineral impurities will contaminate the ground material. For example, naturally occurring calcium carbonate can be present in association with other minerals. Thus, in some embodiments, the inorganic particulate material includes an amount of impurities. In general, however, the inorganic particulate material used in the invention will contain less than about 5% by weight, preferably less than about 1% by weight, of other mineral impurities.

The inorganic particulate material used during the microfibrillating step of the method of the present invention will preferably have a particle size distribution in which at least about 10% by weight of the particles have an e.s.d of less than 2 μm, for example, at least about 20% by weight, or at least about 30% by weight, or at least about 40% by weight or at least about 50% by weight, or at least about 60% by weight, or at least about 70% by weight, or at least about 80% by weight, or at least about 90% by weight, or at least about 95% by weight, or about 100% of the particles have an e.s.d of less than 2 μm.

Unless otherwise stated, particle size properties referred to herein for the inorganic particulate materials are as measured in a well known manner by sedimentation of the particulate material in a fully dispersed condition in an aqueous medium using a Sedigraph 5100 machine as supplied by Micromeritics Instruments Corporation, Norcross, Ga., USA (telephone: +1 770 662 3620; web-site: www.micromeritics.com), referred to herein as a "Micromeritics Sedigraph 5100 unit". Such a machine provides measurements and a plot of the cumulative percentage by weight of particles having a size, referred to in the art as the 'equivalent spherical diameter' (e.s.d), less than given e.s.d values. The mean particle size $d_{50}$ is the value determined in this way of the particle e.s.d at which there are 50% by weight of the particles which have an equivalent spherical diameter less than that $d_{50}$ value.

Alternatively, where stated, the particle size properties referred to herein for the inorganic particulate materials are as measured by the well known conventional method employed in the art of laser light scattering, using a Malvern Mastersizer S machine as supplied by Malvern Instruments Ltd (or by other methods which give essentially the same result). In the laser light scattering technique, the size of particles in powders, suspensions and emulsions may be measured using the diffraction of a laser beam, based on an application of Mie theory. Such a machine provides measurements and a plot of the cumulative percentage by volume of particles having a size, referred to in the art as the 'equivalent spherical diameter' (e.s.d), less than given e.s.d values. The mean particle size $d_{50}$ is the value determined in this way of the particle e.s.d at which there are 50% by volume of the particles which have an equivalent spherical diameter less than that $d_{50}$ value.

In another embodiment, the inorganic particulate material used during the microfibrillating step of the method of the present invention will preferably have a particle size distribution, as measured using a Malvern Mastersizer S machine, in which at least about 10% by volume of the particles have an e.s.d of less than 2 μm, for example, at least about 20% by volume, or at least about 30% by volume, or at least about 40% by volume, or at least about 50% by volume, or at least about 60% by volume, or at least about 70% by volume, or at least about 80% by volume, or at least about 90% by volume, or at least about 95% by volume, or about 100% of the particles by volume have an e.s.d of less than 2 μm.

Unless otherwise stated, particle size properties of the microfibrillated cellulose materials are as are as measured by the well known conventional method employed in the art of laser light scattering, using a Malvern Mastersizer S machine as supplied by Malvern Instruments Ltd (or by other methods which give essentially the same result).

Details of the procedure used to characterise the particle size distributions of mixtures of inorganic particle material and microfibrilated cellulose using a Malvern Mastersizer S machine are provided below.

Another preferred inorganic particulate material for use in the method according to the first aspect of the present invention is kaolin clay. Hereafter, this section of the specification may tend to be discussed in terms of kaolin, and in relation to aspects where the kaolin is processed and/or treated. The invention should not be construed as being limited to such embodiments. Thus, in some embodiments, kaolin is used in an unprocessed form.

Kaolin clay used in this invention may be a processed material derived from a natural source, namely raw natural kaolin clay mineral. The processed kaolin clay may typically contain at least about 50% by weight kaolinite. For example, most commercially processed kaolin clays contain greater than about 75% by weight kaolinite and may contain greater than about 90%, in some cases greater than about 95% by weight of kaolinite.

Kaolin clay used in the present invention may be prepared from the raw natural kaolin clay mineral by one or more other processes which are well known to those skilled in the art, for example by known refining or beneficiation steps.

For example, the clay mineral may be bleached with a reductive bleaching agent, such as sodium hydrosulfite. If sodium hydrosulfite is used, the bleached clay mineral may optionally be dewatered, and optionally washed and again optionally dewatered, after the sodium hydrosulfite bleaching step.

The clay mineral may be treated to remove impurities, e. g. by flocculation, flotation, or magnetic separation techniques well known in the art. Alternatively the clay mineral used in the first aspect of the invention may be untreated in the form of a solid or as an aqueous suspension.

The process for preparing the particulate kaolin clay used in the present invention may also include one or more comminution steps, e.g., grinding or milling. Light comminution of a coarse kaolin is used to give suitable delamination thereof. The comminution may be carried out by use of beads or granules of a plastic (e. g. nylon), sand or ceramic grinding or milling aid. The coarse kaolin may be refined to remove impurities and improve physical properties using well known procedures. The kaolin clay may be treated by a known particle size classification procedure. e.g., screening and centrifuging (or both), to obtain particles having a desired $d_{50}$ value or particle size distribution.

The Microfibrillating Process

In accordance with the first aspect of the invention, there is provided a method of preparing a composition for use as a filler in paper or as a paper coating, comprising a step of microfibrillating a fibrous substrate comprising cellulose in the presence of an inorganic particulate material. According to particular embodiments of the present methods, the microfibrillating step is conducted in the presence of an inorganic particulate material which acts as a microfibrillating agent.

By microfibrillating is meant a process in which microfibrils of cellulose are liberated or partially liberated as individual species or as smaller aggregates as compared to the fibres of the pre-microfibrillated pulp. Typical cellulose fibres (i.e., pre-microfibrillated pulp) suitable for use in papermaking include larger aggregates of hundreds or thousands of individual cellulose microfibrils. By microfibrillating the cellulose, particular characteristics and properties, including but not limited to the characteristic and properties described herein, are imparted to the microfibrillated cellulose and the compositions including the microfibrillated cellulose.

The step of microfibrillating may be carried out in any suitable apparatus, including but not limited to a refiner. In one embodiment, the microfibrillating step is conducted in a grinding vessel under wet-grinding conditions. In another embodiment, the microfibrillating step is carried out in a homogenizer. Each of these embodiments is described in greater detail below.

Wet-Grinding

The grinding is suitably performed in a conventional manner. The grinding may be an attrition grinding process in the presence of a particulate grinding medium, or may be an autogenous grinding process, i.e., one in the absence of a grinding medium. By grinding medium is meant a medium other than the inorganic particulate material which is co-ground with the fibrous substrate comprising cellulose.

The particulate grinding medium, when present, may be of a natural or a synthetic material. The grinding medium may, for example, comprise balls, beads or pellets of any hard mineral, ceramic or metallic material. Such materials may include, for example, alumina, zirconia, zirconium silicate, aluminium silicate or the mullite-rich material which is produced by calcining kaolinitic clay at a temperature in the range of from about 1300° C. to about 1800° C. For example, in some embodiments a Carbolite® grinding media is preferred. Alternatively, particles of natural sand of a suitable particle size may be used.

Generally, the type of and particle size of grinding medium to be selected for use in the invention may be dependent on the properties, such as, e.g., the particle size of, and the chemical composition of, the feed suspension of material to be ground. Preferably, the particulate grinding medium comprises particles having an average diameter in the range of from about 0.1 mm to about 6.0 mm and, more preferably, in the range of from about 0.2 mm to about 4.0 mm. The grinding medium (or media) may be present in an amount up to about 70% by volume of the charge. The grinding media may be present in amount of at least about 10% by volume of the charge, for example, at least about 20% by volume of the charge, or at least about 30% by volume of the charge, or at least about 40% by volume of the charge, or at least about 50% by volume of the charge, or at least about 60% by volume of the charge.

The grinding may be carried out in one or more stages. For example, a coarse inorganic particulate material may be ground in the grinder vessel to a predetermined particle size distribution, after which the fibrous material comprising cellulose is added and the grinding continued until the desired level of microfibrillation has been obtained. The coarse inorganic particulate material used in accordance with the first aspect of this invention initially may have a particle size distribution in which less than about 20% by weight of the particles have an e.s.d of less than 2 μm, for example, less than about 15% by weight, or less than about 10% by weight of the particles have an e.s.d. of less than 2 μm. In another embodiment, the coarse inorganic particulate material used in accordance with the first aspect of this invention initially may have a particle size distribution, as measured using a Malvern Mastersizer S machine, in which less than about 20% by volume of the particles have an e.s.d of less than 2 μm, for example, less than about 15% by volume, or less than about 10% by volume of the particles have an e.s.d. of less than 2 μm The coarse inorganic particulate material may be wet or dry ground in the absence or presence of a grinding medium. In the case of a wet grinding stage, the coarse inorganic particulate material is preferably ground in an aqueous suspension in the presence of a grinding medium. In such a suspension, the coarse inorganic particulate material may preferably be present in an amount of from about 5% to about 85% by weight of the suspension; more preferably in an amount of from about 20% to about 80% by weight of the suspension. Most preferably, the coarse inorganic particulate material may be present in an amount of about 30% to about 75% by weight of the suspension. As described above, the coarse inorganic particulate material may be ground to a particle size distribution such that at least about 10% by weight of the particles have an e.s.d of less than 2 μm, for example, at least about 20% by weight, or at least about 30% by weight, or at least about 40% by weight, or at least about 50% by weight, or at least about 60% by weight, or at least about 70% by weight, or at least about 80% by weight, or at least about 90% by weight, or at least about 95% by weight, or about 100% by weight of the particles, have an e.s.d of less than 2 μm, after which the cellulose pulp is added and the two components are co-ground to microfibrillate the fibres of the cellulose pulp. In another embodiment, the coarse inorganic particulate material is ground to a particle size distribution, as measured using a Malvern Mastersizer S machine such that at least about 10% by volume of the particles have an e.s.d of less than 2 μm, for example, at least about 20% by volume, or at least about 30% by volume or at least about 40% by volume, or at least about 50% by volume, or at least about 60% by volume, or at least about 70% by volume, or at least about 80% by volume, or at least about 90% by volume, or at least about 95% by volume, or about 100% by volume of the particles, have an e.s.d of less than 2 μm, after which the cellulose pulp is added and the two components are co-ground to microfibrillate the fibres of the cellulose pulp In one embodiment, the mean particle size ($d_{50}$) of the inorganic particulate material is reduced during the co-grinding process. For example, the $d_{50}$ of the inorganic particulate material may be reduced by at least about 10% (as measured by a Malvern Mastersizer S machine), for example, the dr of the inorganic particulate material may be reduced by at least about 20%, or reduced by at least about 30%, or reduced by at least about 50%, or reduced by at least about 50%, or reduced by at least about 60%, or reduced by at least about 70%, or reduced by at least about 80%, or reduced by at least about 90%. For example, an inorganic particulate material having a $d_{50}$ of 2.5 μm prior to co-grinding and a $d_{50}$ of 1.5 μm post co-grinding will have been subject to a 40% reduction in particle size. In certain embodiments, the mean particle size of the inorganic particulate material is not significantly reduced during the co-grinding process. By 'not significantly reduced' is meant that the $d_{50}$ of the inorganic particulate material is reduced by less than about 10%, for example, the $d_{50}$ of the inorganic particulate material is reduced by less than about 5%.

The fibrous substrate comprising cellulose may be microfibrillated in the presence of an inorganic particulate material to obtain microfibrillated cellulose having a $d_{50}$ ranging from about 5 to μm about 500 μm, as measured by laser light scattering. The fibrous substrate comprising cellulose may be microfibrillated in the presence of an inorganic particulate material to obtain microfibrillated cellulose having a $d_{50}$ of equal to or less than about 400 μm, for example equal to or less than about 300 μm, or equal to or less than about 200 μm, or equal to or less than about 150 μm, or equal to or less than about 125 μm, or equal to or less than about 100 μm, or equal to or less than about 90 μm, or equal to or less than about 80 μm, or equal to or less than about 70 μm, or equal to or less than about 60 μm, or equal to or less than about 50 μm, or equal to or less than about 40 μm, or equal to or less than about 30 μm, or equal to or less than about 20 μm, or equal to or less than about 10 μm.

The fibrous substrate comprising cellulose may be microfibrillated in the presence of an inorganic particulate material to obtain microfibrillated cellulose having a modal fibre particle size ranging from about 0.1-500 μm and a modal inorganic particulate material particle size ranging from 0.25-20 μm. The fibrous substrate comprising cellulose may be microfibrillated in the presence of an inorganic particulate material to obtain microfibrillated cellulose having a modal fibre particle size of at least about 0.5 μm, for example at least about 10 μm, or at least about 50 μm, or at least about 100 μm, or at least about 150 μm, or at least about 200 μm, or at least about 300 μm, or at least about 400 μm.

The fibrous substrate comprising cellulose may be microfibrillated in the presence of an inorganic particulate material to obtain microfibrillated cellulose having a fibre steepness equal to or greater than about 10, as measured by Malvern. Fibre steepness (i.e., the steepness of the particle size distribution of the fibres) is determined by the following formula:

$$\text{Steepness}=100\times(d_{30}/d_{70})$$

The microfibrillated cellulose may have a fibre steepness equal to or less than about 100. The microfibrillated cellulose may have a fibre steepness equal to or less than about 75, or equal to or less than about 50, or equal to or less than about 40, or equal to or less than about 30. The microfibrillated cellulose may have a fibre steepness from about 20 to about 50, or from about 25 to about 40, or from about 25 to about 35, or from about 30 to about 40.

The grinding is suitably performed in a grinding vessel, such as a tumbling mill (e.g., rod, ball and autogenous), a stirred mill (e.g., SAM or IsaMill), a tower mill, a stirred media detritor (SMD), or a grinding vessel comprising rotating parallel grinding plates between which the feed to be ground is fed.

In one embodiment, the grinding vessel is a tower mill. The tower mill may comprise a quiescent zone above one or more grinding zones. A quiescent zone is a region located towards the top of the interior of tower mill in which minimal or no grinding takes place and comprises microfibrillated cellulose and inorganic particulate material. The quiescent zone is a region in which particles of the grinding medium sediment down into the one or more grinding zones of the tower mill.

The tower mill may comprise a classifier above one or more grinding zones. In an embodiment, the classifier is top mounted and located adjacent to a quiescent zone. The classifier may be a hydrocyclone.

The tower mill may comprise a screen above one or more grind zones. In an embodiment, a screen is located adjacent to a quiescent zone and/or a classifier. The screen may be sized to separate grinding media from the product aqueous suspension comprising microfibrillated cellulose and inorganic particulate material and to enhance grinding media sedimentation.

In an embodiment, the grinding is performed under plug flow conditions. Under plug flow conditions the flow through the tower is such that there is limited mixing of the grinding materials through the tower. This means that at different points along the length of the tower mill the viscosity of the aqueous environment will vary as the fineness of the microfibrillated cellulose increases. Thus, in effect, the grinding region in the tower mill can be considered to comprise one or more grinding zones which have a characteristic viscosity. A skilled person in the art will understand that there is no sharp boundary between adjacent grinding zones with respect to viscosity.

In an embodiment, water is added at the top of the mill proximate to the quiescent zone or the classifier or the screen above one or more grinding zones to reduce the viscosity of the aqueous suspension comprising microfibrillated cellulose and inorganic particulate material at those zones in the mill. By diluting the product microfibrillated cellulose and inorganic particulate material at this point in the mill it has been found that the prevention of grinding media carry over to the quiescent zone and/or the classifier and/or the screen is improved. Further, the limited mixing through the tower allows for processing at higher solids lower down the tower and dilute at the top with limited backflow of the dilution water back down the tower into the one or more grinding zones. Any suitable amount of water which is effective to dilute the viscosity of the product aqueous suspension comprising microfibrillated cellulose and inorganic particulate material may be added. The water may be added continuously during the grinding process, or at regular intervals, or at irregular intervals.

In another embodiment, water may be added to one or more grinding zones via one or more water injection points positioned along the length of the tower mill, or each water injection point being located at a position which corresponds to the one or more grinding zones. Advantageously, the ability to add water at various points along the tower allows for further adjustment of the grinding conditions at any or all positions along the mill.

The tower mill may comprise a vertical impeller shaft equipped with a series of impeller rotor disks throughout its length. The action of the impeller rotor disks creates a series of discrete grinding zones throughout the mill.

In another embodiment, the grinding is performed in a screened grinder, preferably a stirred media detritor. The screened grinder may comprise one or more screen(s) having a nominal aperture size of at least about 250 μm, for example, the one or more screens may have a nominal aperture size of at least about 300 μm, or at least about 350 μm, or at least about 400 μm, or at least about 450 μm, or at least about 500 μm, or at least about 550 μm, or at least about 600 μm, or at least about 650 μm, or at least about 700 μm, or at least about 750 μm, or at least about 800 μm, or at least about 850 μm, or at or least about 900 μm, or at least about 1000 μm.

The screen sizes noted immediately above are applicable to the tower mill embodiments described above.

As noted above, the grinding may be performed in the presence of a grinding medium. In an embodiment, the grinding medium is a coarse media comprising particles having an average diameter in the range of from about 1 mm to about 6 mm, for example about 2 mm, or about 3 mm, or about 4 mm, or about 5 mm.

In another embodiment, the grinding media has a specific gravity of at least about 2.5, for example, at least about 3, or at least about 3.5, or at least about 4.0, or at least about 4.5, or least about 5.0, or at least about 5.5, or at least about 6.0.

In another embodiment, the grinding media comprises particles having an average diameter in the range of from about 1 mm to about 6 mm and has a specific gravity of at least about 2.5.

In another embodiment, the grinding media comprises particles having an average diameter of about 3 mm and specific gravity of about 2.7.

As described above, the grinding medium (or media) may present in an amount up to about 70% by volume of the charge. The grinding media may be present in amount of at least about 10% by volume of the charge, for example, at least about 20% by volume of the charge, or at least about 30% by volume of the charge, or at least about 40% by volume of the charge, or at least about 50% by volume of the charge, or at least about 60% by volume of the charge.

In one embodiment, the grinding medium is present in amount of about 50% by volume of the charge.

By 'charge' Is meant the composition which is the feed fed to the grinder vessel. The charge includes of water, grinding media, fibrous substrate comprising cellulose and inorganic particulate material, and any other optional additives as described herein. The use of a relatively coarse and/or dense media has the advantage of improved (i.e., faster) sediment rates and reduced media carry over through the quiescent zone and/or classifier and/or screen(s).

A further advantage in using relatively coarse grinding media is that the mean particle size ($d_{50}$) of the inorganic particulate material may not be significantly reduced during the grinding process such that the energy imparted to the grinding system is primarily expended in microfibrillating the fibrous substrate comprising cellulose.

A further advantage in using relatively coarse screens is that a relatively coarse or dense grinding media can be used in the microfibrillating step. In addition, the use of relatively coarse screens (i.e., having a nominal aperture of least about 250 um) allows a relatively high solids product to be processed and removed from the grinder, which allows a relatively high solids feed (comprising fibrous substrate comprising cellulose and inorganic particulate material) to be processed in an economically viable process. As discussed below, it has been found that a feed having a high initial solids content is desirable in terms of energy sufficiency. Further, it has also been found that product produced (at a given energy) at lower solids has a coarser particle size distribution.

As discussed in the 'Background' section above, the present invention seeks to address the problem of preparing microfibrillated cellulose economically on an industrial scale.

Thus, in accordance with one embodiment, the fibrous substrate comprising cellulose and inorganic particulate material are present in the aqueous environment at an initial solids content of at least about 4 wt %, of which at least about 2% by weight is fibrous substrate comprising cellulose. The initial solids content may be at least about 10 wt %, or at least about 20 wt %, or at least about 30 wt %, or at least about at least 40 wt %. At least about 5% by weight of the initial solids content may be fibrous substrate comprising cellulose, for example, at least about 10%, or at least about 15%, or at least about 20% by weight of the initial solids content may be fibrous substrate comprising cellulose.

In another embodiment, the grinding is performed in a cascade of grinding vessels, one or more of which may comprise one or more grinding zones. For example, the fibrous substrate comprising cellulose and the inorganic particulate material may be ground in a cascade of two or more grinding vessels, for example, a cascade of three or more grinding vessels, or a cascade of four or more grinding vessels, or a cascade of five or more grinding vessels, or a cascade of six or more grinding vessels, or a cascade of seven or more grinding vessels, or a cascade of eight or more grinding vessels, or a cascade of nine or more grinding vessels in series, or a cascade comprising up to ten grinding vessels. The cascade of grinding vessels may be operatively linked in series or parallel or a combination of series and parallel. The output from and/or the input to one or more of the grinding vessels in the cascade may be subjected to one or more screening steps and/or one or more classification steps.

The total energy expended in a microfibrillation process may be apportioned equally across each of the grinding vessels in the cascade. Alternatively, the energy input may vary between some or all of the grinding vessels in the cascade.

A person skilled in the art will understand that the energy expended per vessel may vary between vessels in the cascade depending on the amount of fibrous substrate being microfibrillated in each vessel, and optionally the speed of grind in each vessel, the duration of grind in each vessel, the type of grinding media in each vessel and the type and amount of inorganic particulate material. The grinding conditions may be varied in each vessel in the cascade in order to control the particle size distribution of both the microfibrillated cellulose and the inorganic particulate material. For example, the grinding media size may be varied between successive vessels in the cascade in order to reduce grinding of the inorganic particulate material and to target grinding of the fibrous substrate comprising cellulose.

In an embodiment the grinding is performed in a closed circuit. In another embodiment, the grinding is performed in an open circuit. The grinding may be performed in batch mode. The grinding may be performed in a re-circulating batch mode.

As described above, the grinding circuit may include a pre-grinding step in which coarse inorganic particulate ground in a grinder vessel to a predetermined particle size distribution, after which fibrous material comprising cellulose is combined with the pre-ground inorganic particulate material and the grinding continued in the same or different grinding vessel until the desired level of microfibrillation has been obtained.

As the suspension of material to be ground may be of a relatively high viscosity, a suitable dispersing agent may preferably be added to the suspension prior to grinding. The dispersing agent may be, for example, a water soluble condensed phosphate, polysilicic acid or a salt thereof, or a polyelectrolyte, for example a water soluble salt of a poly (acrylic acid) or of a poly(methacrylic acid) having a number average molecular weight not greater than 80,000. The amount of the dispersing agent used would generally be in the range of from 0.1 to 2.0% by weight, based on the weight of the dry inorganic particulate solid material. The suspension may suitably be ground at a temperature in the range of from 4° C. to 100° C.

Other additives which may be included during the microfibrillation step include: carboxymethyl cellulose, amphoteric carboxymethyl cellulose, oxidising agents, 2,2,6,6-Tetramethylpiperidine-1-oxyl (TEMPO), TEMPO derivatives, and wood degrading enzymes.

The pH of the suspension of material to be ground may be about 7 or greater than about 7 (i.e., basic), for example, the pH of the suspension may be about 8, or about 9, or about 10, or about 11. The pH of the suspension of material to be ground may be less than about 7 (i.e., acidic), for example, the pH of the suspension may be about 6, or about 5, or about 4, or about 3. The pH of the suspension of material to be ground may be adjusted by addition of an appropriate amount of acid or base. Suitable bases included alkali metal hydroxides, such as, for example NaOH. Other suitable bases are sodium carbonate and ammonia. Suitable acids included inorganic acids, such as hydrochloric and sulphuric acid, or organic acids. An exemplary acid is orthophosphoric acid.

The amount of inorganic particulate material and cellulose pulp in the mixture to be co-ground may vary in a ratio of from about 99.5:0.5 to about 0.5:99.5, based on the dry weight of inorganic particulate material and the amount of dry fibre in the pulp, for example, a ratio of from about 99.5:0.5 to about 50:50 based on the dry weight of inorganic particulate material and the amount of dry fibre in the pulp. For example, the ratio of the amount of inorganic particulate material and dry fibre may be from about 99.5:0.5 to about 70:30. In an embodiment, the ratio of inorganic particulate material to dry fibre is about 80:20, or for example, about 85:15, or about 90:10, or about 91:9, or about 92:8, or about 93:7, or about 94:6, or about 95:5, or about 96:4, or about 97:3, or about 98:2, or about 99:1. In a preferred embodiment, the weight ratio of inorganic particulate material to dry fibre is about 95:5. In another preferred embodiment, the weight ratio of inorganic particulate material to dry fibre is about 90:10. In another preferred embodiment, the weight ratio of inorganic particulate material to dry fibre is about 85:15. In another preferred embodiment, the weight ratio of inorganic particulate material to dry fibre is about 80:20.

The total energy input in a typical grinding process to obtain the desired aqueous suspension composition may typically be between about 100 and 1500 $kWht^{-1}$ based on the total dry weight of the inorganic particulate filler. The total energy input may be less than about 1000 $kWht^{1}$, for example, less than about 800 $kWht^{-1}$, less than about 600 $kWht^{-1}$, less than about 500 $kWht^{-1}$, less than about 400 $kWht^{-1}$, less than about 300 $kWht^{1}$, or less than about 200 $kWht^{-1}$. As such, the present inventors have surprisingly found that a cellulose pulp can be microfibrillated at relatively low energy input when it is co-ground in the presence of an inorganic particulate material. As will be apparent, the total energy input per tonne of dry fibre in the fibrous substrate comprising cellulose will be less than about 10,000 $kWht^{-1}$, for example, less than about 9000 $kWht^{-1}$, or less than about 8000 $kWht^{-1}$, or less than about 7000 $kWht^{-1}$, or less than about 6000 $kWht^{-1}$, or less than about 5000 $kWht^{-1}$, for example less than about 4000 kWht−1, less than about 3000 $kWht^{-1}$, less than about 2000 $kWht^{-1}$, less than about 1500 $kWht^{-1}$, less than about 1200 $kWht^{-1}$, less than about 1000 $kWht^{-1}$, or less than about 800 $kWht^{-1}$. The total energy input varies depending on the amount of dry fibre in the fibrous substrate being microfibrillated, and optionally the speed of grind and the duration of grind.

Homogenizing

Microfibrillation of the fibrous substrate comprising cellulose may be effected under wet conditions in the presence of the inorganic particulate material by a method in which the mixture of cellulose pulp and inorganic particulate material is pressurized (for example, to a pressure of about 500 bar) and then passed to a zone of lower pressure. The rate at which the mixture is passed to the low pressure zone is sufficiently high and the pressure of the low pressure zone is sufficiently low as to cause microfibrillation of the cellulose fibres. For example, the pressure drop may be effected by forcing the mixture through an annular opening that has a narrow entrance orifice with a much larger exit orifice. The drastic decrease in pressure as the mixture accelerates into a larger volume (i.e., a lower pressure zone) induces cavitation which causes microfibrillation. In an embodiment, microfibrillation of the fibrous substrate comprising cellulose may be effected in a homogenizer under wet conditions in the presence of the inorganic particulate material. In the homogenizer, the cellulose pulp-inorganic particulate material mixture is pressurized (for example, to a pressure of about 500 bar), and forced through a small nozzle or orifice. The mixture may be pressurized to a pressure of from about 100 to about 1000 bar, for example to a pressure of equal to or greater than 300 bar, or equal to or greater than about 500, or equal to or greater than about 200 bar, or equal to or greater than about 700 bar. The homogenization subjects the fibres to high shear forces such that as the pressurized cellulose pulp exits the nozzle or orifice, cavitation causes microfibrillation of the cellulose fibres in the pulp. Additional water may be added to improve flowability of the suspension through the homogenizer. The resulting aqueous suspension comprising microfibrillated cellulose and inorganic particulate material may be fed back into the inlet of the homogenizer for multiple passes through the homogenizer. In a preferred embodiment, the inorganic particulate material is a naturally platy mineral, such as kaolin. As such, homogenization not only facilitates microfibrillation of the cellulose pulp, but also facilitates delamination of the platy particulate material.

A platy particulate material, such as kaolin, is understood to have a shape factor of at least about 10, for example, at least about 15, or at least about 20, or at least about 30, or at least about 40, or at least about 50, or at least about 60, or at least about 70, or at least about 80, or at least about 90, or at least about 100. Shape factor, as used herein, is a measure of the ratio of particle diameter to particle thickness for a population of particles of varying size and shape as measured using the electrical conductivity methods, apparatuses, and equations described in U.S. Pat. No. 5,576,617, which is incorporated herein by reference.

A suspension of a platy inorganic particulate material, such as kaolin, may be treated in the homogenizer to a predetermined particle size distribution in the absence of the fibrous substrate comprising cellulose, after which the fibrous material comprising cellulose is added to the aqueous slurry of inorganic particulate material and the combined suspension is processed in the homogenizer as described above. The homogenization process is continued, including one or more passes through the homogenizer, until the desired level of microfibrillation has been obtained. Similarly, the platy inorganic particulate material may be treated in a grinder to a predetermined particle size distribution and then combined with the fibrous material comprising cellulose followed by processing in the homogenizer.

An exemplary homogenizer is a Manton Gaulin (APV) homogenizer.

After the microfibrillation step has been carried out, the aqueous suspension comprising microfibrillated cellulose and inorganic particulate material may be screened to remove fibre above a certain size and to remove any grinding medium. For example, the suspension can be subjected to screening using a sieve having a selected nominal aperture size in order to remove fibres which do not pass through the sieve. Nominal aperture size means the nominal central separation of opposite sides of a square aperture or the nominal diameter of a round aperture. The sieve may be a BSS sieve (in accordance with BS 1796) having a nominal aperture size of 150 μm, for example, a nominal aperture size 125 μm, or 106 μm, or 90 μm, or 74 μm, or 63 μm, or 53 μm, 45 μm, or 38 μm. In one embodiment, the aqueous suspension is screened using a BSS sieve having a nominal aperture of 125 μm. The aqueous suspension may then be optionally dewatered.

The Aqueous Suspension

The aqueous suspensions of this invention produced in accordance with the methods described above are suitable for use in a method of making paper or coating paper.

As such, the present invention is directed to an aqueous suspension comprising, consisting of, or consisting essentially of microfibrillated cellulose and an inorganic particulate material and other optional additives. The aqueous suspension is suitable for use in a method of making paper or coating paper. The other optional additives include dispersant, biocide, suspending aids, salt(s) and other additives, for example, starch or carboxy methyl cellulose or polymers, which may facilitate the interaction of mineral particles and fibres during or after grinding.

The inorganic particulate material may have a particle size distribution such that at least about 10% by weight, for example at least about 20% by weight, for example at least about 30% by weight, for example at least about 40% by weight, for example at least about 50% by weight for example at least about 60% by weight, for example at least about 70% by weight, for example at least about 80% by weight, for example at least about 90% by weight, for example at least about 95% by weight, or for example about 100% of the particles have an e.s.d of less than 2 μm.

In another embodiment, the inorganic particulate material may have a particle size distribution, as measured by a Malvern Mastersizer S machine, such that at least about 10% by volume, for example at least about 20% by volume, for example at least about 30% by volume, for example at least about 40% by volume, for example at least about 50% by volume, for example at least about 60% by volume, for example at least about 70% by volume, for example at least about 80% by volume, for example at least about 90% by volume, for example at least about 95% by volume, or for example about 100% by volume of the particles have an e.s.d of less than 2 μm.

The amount of inorganic particulate material and cellulose pulp in the mixture to be co-ground may vary in a ratio of from about 99.5:0.5 to about 0.5:99.5, based on the dry weight of inorganic particulate material and the amount of dry fibre in the pulp, for example, a ratio of from about 99.5:0.5 to about 50:50 based on the dry weight of inorganic particulate material and the amount of dry fibre in the pulp. For example, the ratio of the amount of inorganic particulate material and dry fibre may be from about 99.5:0.5 to about 70:30. In an embodiment, the ratio of inorganic particulate material to dry fibre is about 80:20, or for example, about 85:15, or about 90:10, or about 91:9, or about 92:8, or about 93:7, or about 94:6, or about 95:5, or about 96:4, or about 97:3, or about 98:2, or about 99:1. In a preferred embodiment, the weight ratio of inorganic particulate material to dry fibre is about 95:5. In another preferred embodiment, the weight ratio of inorganic particulate material to dry fibre is about 90:10. In another preferred embodiment the weight ratio of inorganic particulate material to dry fibre is about 85:15. In another preferred embodiment, the weight ratio of inorganic particulate material to dry fibre is about 80:20.

In an embodiment, the composition does not include fibres too large to pass through a BSS sieve (in accordance with BS 1796) having a nominal aperture size of 150 μm, for example, a nominal aperture size of 125 μm, 106 μm, or 90 μm, or 74 μm, or 63 μm, or 53 μm, 45 μm, or 38 μm. In one embodiment, the aqueous suspension is screened using a BSS sieve having a nominal aperture of 125 μm.

It will be understood therefore that amount (i.e., % by weight) of microfibrillated cellulose in the aqueous suspension after grinding or homogenizing may be less than the amount of dry fibre in the pulp if the ground or homogenized suspension is treated to remove fibres above a selected size. Thus, the relative amounts of pulp and inorganic particulate material fed to the grinder or homogenizer can be adjusted depending on the amount of microfibrillated cellulose that is required in the aqueous suspension after fibres above a selected size are removed.

In an embodiment, the inorganic particulate material is an alkaline earth metal carbonate, for example, calcium carbonate. The inorganic particulate material may be ground calcium carbonate (GCC) or precipitated calcium carbonate (PCC), or a mixture of GCC and PCC. In another embodiment, the inorganic particulate material is a naturally platy mineral, for example, kaolin. The inorganic particulate material may be a mixture of kaolin and calcium carbonate, for example, a mixture of kaolin and GCC, or a mixture of kaolin and PCC, or a mixture of kaolin, GCC and PCC.

In another embodiment, the aqueous suspension is treated to remove at least a portion or substantially all of the water to form a partially dried or essentially completely dried product. For example, at least about 10% by volume of water in the aqueous suspension may be removed from the aqueous suspension, for example, at least about 20% by volume, or at least about 30% by volume, or least about 40% by volume, or at least about 50% by volume, or at least about 60% by volume, or at least about 70% by volume or at least about 80% by volume or at least about 90% by volume, or at least about 100% by volume of water in the aqueous suspension may be removed. Any suitable technique can be used to remove water from the aqueous suspension including, for example, by gravity or vacuum-assisted drainage, with or without pressing, or by evaporation, or by filtration, or by a combination of these techniques. The partially dried or essentially completely dried product will comprise microfibrillated cellulose and inorganic particulate material and any other optional additives that may have been added to the aqueous suspension prior to drying. The partially dried or essentially completely dried product may be stored or packaged for sale. The partially dried or essentially completely dried product may be optionally re-hydrated and incorporated in papermaking compositions and other paper products, as described herein.

Paper Products and Processes for Preparing Same

The aqueous suspension comprising microfibrillated cellulose and inorganic particulate material can be incorporated in papermaking compositions, which in turn can be used to prepare paper products. The term paper product, as used in connection with the present invention, should be understood to mean all forms of paper, including board such as, for example, white-lined board and linerboard, cardboard, paperboard, coated board, and the like. There are numerous types of paper, coated or uncoated, which may be made according to the present invention, including paper suitable for books, magazines, newspapers and the like, and office papers. The paper may be calendered or super calendered as appropriate; for example super calendered magazine paper for rotogravure and offset printing may be made according to the present methods. Paper suitable for light weight coating (LWC), medium weight coating (MWC) or machine finished pigmentisation (MFP) may also be made according to the present methods. Coated paper and board having barrier properties suitable for food packaging and the like may also be made according to the present methods.

In a typical papermaking process, a cellulose-containing pulp is prepared by any suitable chemical or mechanical treatment, or combination thereof, which are well known in the art. The pulp may be derived from any suitable source such as wood, grasses (e.g., sugarcane, bamboo) or rags (e.g., textile waste, cotton, hemp or flax). The pulp may be bleached in accordance with processes which are well known to those skilled in the art and those processes suitable for use in the present invention will be readily evident. The bleached cellulose pulp may be beaten, refined, or both, to a predetermined freeness (reported in the art as Canadian standard freeness (CSF) in $cm^3$). A suitable paper stock is then prepared from the bleached and beaten pulp.

The papermaking composition of the present invention typically comprises, in addition to the aqueous suspension of microfibrillated cellulose and inorganic particulate material, paper stock and other conventional additives known in the art. The papermaking composition of the present invention may comprise up to about 50% by weight inorganic particulate material derived from the aqueous suspension comprising microfibrillated cellulose and inorganic particulate material based on the total dry contents of the papermaking composition. For example, the papermaking composition may comprise at least about 2% by weight, or at least about 5% by weight, or at least about 10% by weight, or at least about 15% by weight, or at least about 20% by weight, or at least about 25% by weight, or at least about 30% by weight, or at least about 35% by weight, or at least about 40% by weight, or at least about 45% by weight, or at least about 50% by weight, or at least about 60% by weight, or at least about 70% by weight, or at least about 80% by weight of inorganic particulate material derived from the aqueous suspension comprising microfibrillated cellulose and inorganic particulate material based on the total dry contents of the papermaking composition. The microfibrillated cellulose material may have a fibre steepness of greater than about 10, for examples, from about 20 to about 50, or from about 25 to about 40, or from about 25 to 35, or from about 30 to about 40. The papermaking composition may also contain a non-ionic, cationic or an anionic retention aid or microparticle retention system in an amount in the range from about 0.1 to 2% by weight, based on the dry weight of the aqueous suspension comprising microfibrillated cellulose and inorganic particulate material. It may also contain a sizing agent which may be, for example, a long chain alkylketene dimer, a wax emulsion or a succinic acid derivative. The composition may also contain dye and/or an optical brightening agent. The composition may also comprise dry and wet strength aids such as, for example, starch or epichlorhydrin copolymers.

In accordance with the eighth aspect described above, the present invention is directed to a process for making a paper product comprising: (i) obtaining or preparing a fibrous substrate comprising cellulose in the form of a pulp suitable for making a paper product; (ii) preparing a papermaking composition from the pulp in step (i), the aqueous suspension of this invention comprising microfibrillated cellulose and inorganic particulate material, and other optional additives (such as, for example, a retention aid, and other additives such as those described above); and (iii) forming a paper product from said papermaking composition. As noted above, the step of forming a pulp may take place in the grinder vessel or homogenizer by addition of the fibrous substrate comprising cellulose in a dry state, for example, in the form of a dry paper broke or waste, directly to the grinder vessel. The aqueous environment in the grinder vessel or homogenizer will then facilitate the formation of a pulp.

In one embodiment, an additional filler component (i.e., a filler component other than the inorganic particulate material which is co-ground with the fibrous substrate comprising cellulose) can be added to the papermaking composition prepared in step (ii). Exemplary filler components are PCC, GCC, kaolin, or mixtures thereof. An exemplary PCC is scalenohedral PCC. In an embodiment, the weight ratio of the inorganic particulate material to the additional filler component in the papermaking composition is from about 1:1 to about 1:30, for example, from about 1:1 to about 1:20, for example, from about 1:1 to about 1:15, for example from about 1:1 to about 1:10, for example from about 1:1 to about 1:7, for example, from about 1:3 to about 1:6, or about 1:1, or about 1:2, or about 1:3, or about 1:4, or about 1:5. Paper products made from such papermaking compositions may exhibit greater strength compared to paper products comprising only inorganic particulate material, such as for example PCC, as filler. Paper products made from such papermaking compositions may exhibit greater strength compared to a paper product in which inorganic particulate material and a fibrous substrate comprising cellulose are prepared (e.g., ground) separately and are admixed to form a paper making composition. Equally, paper products prepared from a papermaking composition according to the present invention may exhibit a strength which is comparable to paper products comprising less inorganic particulate material. In other words, paper products can be prepared from a paper making composition according to the present at higher filler loadings without loss of strength.

The steps in the formation of a final paper product from a papermaking composition are conventional and well know in the art and generally comprise the formation of paper sheets having a targeted basis weight, depending on the type of paper being made.

Additional economic benefits can be achieved through the methods of the present invention in that the cellulose substrate for making the aqueous suspension can be derived from the same cellulose pulp formed for making the papermaking composition and the final paper product. As such, and in accordance with the ninth aspect described above, the present invention is directed to a an integrated process for making a paper product comprising: (i) obtaining or preparing a fibrous substrate comprising cellulose in the form of a pulp suitable for making a paper product; (ii) microfibrillating a portion of said fibrous substrate comprising cellulose in accordance with the first aspect of the invention to prepare an aqueous suspension comprising microfibrillated cellulose and inorganic particulate material; (iii) preparing a papermaking composition from the pulp in step (i), the aqueous suspension prepared in step (II), and other optional additives; and (iv) forming a paper product from said papermaking composition.

Thus, since the cellulose substrate for preparing the aqueous suspension has already been prepared for the purpose of making the papermaking compositions, the step of forming the aqueous suspension does not necessarily require a separate step of preparing the fibrous substrate comprising cellulose.

Paper products prepared using the aqueous suspension of the present invention have surprisingly been found to exhibit improved physical and mechanical properties whilst at the same time enabling the inorganic particulate material to be incorporated at relatively high loading levels. Thus, improved papers can be prepared at relatively less cost. For example, paper products prepared from papermaking compositions comprising the aqueous suspension of the present invention have been found to exhibit improved retention of the inorganic particulate material filler compared to paper products which do not contain any microfibrillated cellulose. Paper products prepared from papermaking compositions comprising the aqueous suspension of the present invention have also been found to exhibit improved burst strength and tensile strength. Further, the incorporation of the microfibrillated cellulose has been found to reduce porosity compared to paper comprising the same amount of filler but no microfibrillated cellulose. This is advantageous since high filler loading levels are generally associated with relatively high values of porosity and are detrimental to printability.

Paper Coating Composition and Coating Process

The aqueous suspension of the present invention can be used as a coating composition without the addition of further additives. However, optionally, a small amount of thickener such as carboxymethyl cellulose or alkali-swellable acrylic thickeners or associated thickeners may be added.

The coating composition according to the present invention may contain one or more optional additional components, if desired. Such additional components, where present, are suitably selected from known additives for paper coating compositions.

Some of these optional additives may provide more than one function in the coating composition. Examples of known classes of optional additives are as follows:

(a) one or more additional pigments: the compositions described herein can be used as sole pigments in the paper coating compositions, or may be used in conjunction with one another or with other known pigments, such as, for example, calcium sulphate, satin white, and so-called 'plastic pigment'. When a mixture of pigments is used, the total pigment solids content is preferably present in the composition in an amount of at least about 75 wt % of the total weight of the dry components of the coating composition;

(b) one or more binding or cobinding agents: for example, latex, which may, optionally, be carboxylated, including: a styrene-butadiene rubber latex; an acrylic polymer latex; a polyvinyl acetate latex; or a styrene acrylic copolymer latex, starch derivatives, sodium carboxymethyl cellulose, polyvinyl alcohol, and proteins;

(c) one or more cross linkers: for example, in levels of up to about 5% by weight; e.g., glyoxals, melamine formaldehyde resins, ammonium zirconium carbonates; one or more dry or wet pick improvement additives: e.g., in levels up to about 2% by weight, e.g., melamine resin, polyethylene emulsions, urea formaldehyde, melamine formaldehyde, polyamide, calcium stearate, styrene maleic anhydride and others; one or more dry or wet rub improvement and abrasion resistance additives: e.g., in levels up to about 2% by weight, e.g., glyoxal based resins, oxidised polyethylenes, melamine resins, urea formaldehyde, melamine formaldehyde, polyethylene wax, calcium stearate and others; one or more water resistance additives: e.g., in levels up to about 2% by weight, e.g., oxidised polyethylenes, ketone resin, anionic latex, polyurethane, SMA, glyoxal, melamine resin, urea formaldehyde, melamine formaldehyde, polyamide, glyoxals, stearates and other materials commercially available for this function:

(d) one or more water retention aids: for example, in levels up to about 2% by weight, e.g., sodium carboxymethyl cellulose, hydroxyethyl cellulose, PVOH (polyvinyl alcohol), starches, proteins, polyacrylates, gums, alginates, polyacrylamide bentonite and other commercially available products sold for such applications;

(e) one or more viscosity modifiers and/or thickeners: for example, in levels up to about 2% by weight; e.g., acrylic associative thickeners, polyacrylates, emulsion copolymers, dicyanamide, triols, polyoxyethylene ether, urea, sulphated castor oil, polyvinyl pyrrolidone, CMC (carboxymethyl celluloses, for example sodium carboxymethyl cellulose), sodium alginate, xanthan gum, sodium silicate, acrylic acid copolymers, HMC (hydroxymethyl celluloses), HEC (hydroxyethyl celluloses) and others;

(f) one or more lubricity/calendering aids: for example, in levels up to about 2% by weight, e.g., calcium stearate, ammonium stearate, zinc stearate, wax emulsions, waxes, alkyl ketene dimer, glycols; one or more gloss-ink hold-out additives: e.g., in levels up to about 2% by weight, e.g., oxidised polyethylenes, polyethylene emulsions, waxes, casein, guar gum, CMC, HMC, calcium stearate, ammonium stearate, sodium alginate and others;

(g) one or more dispersants: the dispersant is a chemical additive capable, when present in a sufficient amount, of acting on the particles of the particulate inorganic material to prevent or effectively restrict flocculation or agglomeration of the particles to a desired extent, according to normal processing requirements. The dispersant may be present in levels up to about 1% by weight, and includes, for example, polyelectrolytes such as polyacrylates and copolymers containing polyacrylate species, especially polyacrylate salts (e.g., sodium and aluminium optionally with a group II condensed sodium phosphate, non-ionic surfactants, alkanolamine and other reagents commonly used for this function. The dispersant may, for example, be selected from conventional dispersant materials commonly used in the processing and grinding of inorganic particulate materials. Such dispersants will be well recognised by those skilled in this art. They are generally water-soluble salts capable of supplying anionic species which in their effective amounts can adsorb on the surface of the inorganic particles and thereby inhibit aggregation of the particles. The unsolvated salts suitably include alkali metal cations such as sodium. Solvation may in some cases be assisted by making the aqueous suspension slightly alkaline. Examples of suitable dispersants include: water soluble condensed phosphates, e.g., polymetaphosphate salts (general form of the sodium salts: $(NaPO_3)_x$] such as tetrasodium metaphosphate or so-called "sodium hexametaphosphate" (Graham's salt); water-soluble salts of polysilicic acids; polyelectrolytes; salts of homopolymers or copolymers of acrylic acid or methacrylic acid, or salts of polymers of other derivatives of acrylic acid, suitably having a weight average molecular mass of less than about 20,000. Sodium hexametaphosphate and sodium polyacrylate, the latter suitably having a weight average molecular mass in the range of about 1,500 to about 10,000, are especially preferred;

(h) one or more antifoamers and defoamers: for example, in levels up to about 1% by weight, e.g., blends of surfactants, tributyl phosphate, fatty polyoxyethylene esters plus fatty alcohols, fatty acid soaps, silicone emulsions and other silicone containing compositions, waxes and inorganic particulates in mineral oil, blends of emulsified hydrocarbons and other compounds sold commercially to carry out this function;

(i) one or more optical brightening agents (OBA) and fluorescent whitening agents (FWA): for example, in levels up to about 1% by weight, e.g., stilbene derivatives;

(j) one or more dyes: for example, in levels up to about 0.5% by weight;

(k) one or more biocides/spoilage control agents: for example, in levels up to about 1% by weight, e.g., oxidizing biocides such as chlorine gas, chlorine dioxide gas, sodium hypochlorite, sodium hypobromite, hydrogen, peroxide, peracetic oxide, ammonium bromide/sodium hypochlorite, or non-oxidising biocides such as GLUT (Glutaraldehyde, CAS No 90045-36-6), ISO (CIT/MIT) (Isothiazolinone, CAS No 55956-84-9 & 96118-96-6), ISO (BIT/MIT) (Isothiazolinone). ISO (BIT) (Isothiazolinone, CAS No 2634-33-5), DBNPA, BNPD (Bronopol), NaOPP, CARBAMATE, THIONE (Dazomet), EDDM—dimethanol (O-formal), HT—Triazine (N-formal), THPS—tetrakis (O-formal), TMAD—diurea (N-formal), metaborate, sodium dodecylbenene sulphonate, thiocyanate, organosulphur, sodium benzoate and other compounds sold commercially for this function, e.g., the range of biocide polymers sold by Nalco;

(l) one or more levelling and evening aids: for example, in levels up to about 2% by weight, e.g., non-ionic polyol, polyethylene emulsions, fatty acid, esters and alcohol derivatives, alcohol/ethylene oxide, calcium stearate and other compounds sold commercially for this function;

(m) one or more grease and oil resistance additives: for example, in levels up to about 2% by weight, e.g., oxidised polyethylenes, latex, SMA (styrene maleic anhydride), polyamide, waxes, alginate, protein, CMC, and HMC.

Any of the above additives and additive types may be used alone or in admixture with each other and with other additives, if desired.

For all of the above additives, the percentages by weight quoted are based on the dry weight of inorganic particulate material (100%) present in the composition. Where the additive is present in a minimum amount, the minimum amount may be about 0.01% by weight based on the dry weight of pigment.

The coating process is carried out using standard techniques which are well known to the skilled person. The coating process may also involve calendaring or supercalendering the coated product.

Methods of coating paper and other sheet materials, and apparatus for performing the methods, are widely published and well known. Such known methods and apparatus may conveniently be used for preparing coated paper. For example, there is a review of such methods published in Pulp and Paper International, May 1994, page 18 et seq. Sheets may be coated on the sheet forming machine, i.e., "on-machine," or "off-machine" on a coater or coating machine. Use of high solids compositions is desirable in the coating method because it leaves less water to evaporate subsequently. However, as is well known in the art, the solids level should not be so high that high viscosity and leveling problems are introduced. The methods of coating may be performed using an apparatus comprising (i) an application for applying the coating composition to the material to be coated and (ii) a metering device for ensuring that a correct level of coating composition is applied. When an excess of coating composition is applied to the applicator, the metering device is downstream of it. Alternatively, the correct amount of coating composition may be applied to the applicator by the metering device, e.g., as a film press. At the points of coating application and metering, the paper web support ranges from a backing roll, e.g., via one or two applicators, to nothing (i.e., just tension). The time the coating is in contact with the paper before the excess is finally removed is the dwell time—and this may be short, long or variable.

The coating is usually added by a coating head at a coating station. According to the quality desired, paper grades are uncoated, single-coated, double-coated and even triple-coated. When providing more than one coat the initial coat (precoat) may have a cheaper formulation and optionally coarser pigment in the coating composition. A coater that is applying coating on each side of the paper will have two or four coating heads, depending on the number of coating layers applied on each side. Most coating heads coat only one side at a time, but some roll coaters (e.g., film presses, gate rolls, and size presses) coat both sides in one pass.

Examples of known coaters which may be employed include, without limitation, air knife coaters, blade coaters, rod coaters, bar coaters, multi-head coaters, roll coaters, roll or blade coaters, cast coaters, laboratory coaters, gravure coaters, kisscoaters, liquid application systems, reverse roll coaters, curtain coaters, spray coaters and extrusion coaters.

Water may be added to the solids comprising the coating composition to give a concentration of solids which is preferably such that, when the composition is coated onto a sheet to a desired target coating weight, the composition has a rheology which is suitable to enable the composition to be coated with a pressure (I.e., a blade pressure) of between 1 and 1.5 bar.

Calendering is a well known process in which paper smoothness and gloss is improved and bulk is reduced by passing a coated paper sheet between calender nips or rollers one or more times. Usually, elastomer-coated rolls are employed to give pressing of high solids compositions. An elevated temperature may be applied. One or more (e.g., up to about 12, or sometimes higher) passes through the nips may be applied.

Coated paper products prepared in accordance with the present invention and which contain optical brightening agent in the coating may exhibit a brightness as measured according to ISO Standard 11475 which is at least 2 units greater, for example at least 3 units greater compared to a coated paper product which does not comprise microfibrillated cellulose which has been prepared in accordance with the present invention. Coated paper products prepared in accordance with the present invention may exhibit a Parker Print Surf smoothness measured according to ISO standard 8971-4 (1992) which is at least 0.5 μm smoother, for example at least about 0.6 μm smoother, or at least about 0.7 μm smoother compared to a coated paper product which does not comprise microfibrillated cellulose which has been prepared in accordance with the present invention.

For the avoidance of doubt, the present application is directed to the subject-matter described in the following numbered paragraphs:

1. A paper product comprising a paper coating composition including a co-processed microfibrillated cellulose and inorganic particulate material composition, wherein the paper product has:

i) a first tensile strength greater than a second tensile strength of the paper product comprising the paper coating composition devoid of the co-processed microfibrillated cellulose and inorganic particulate material composition;

ii) a first tear strength greater than a second tear strength of the paper product comprising the paper coating composition devoid of the co-processed microfibrillated cellulose and inorganic particulate material composition; and/or iii) a first gloss greater than a second gloss of the paper product comprising the paper coating composition devoid of the co-processed microfibrillated cellulose and inorganic particulate material composition and/or iv) a first burst strength greater than a second burst strength of the paper product comprising the paper coating composition devoid of the co-processed microfibrillated cellulose and inorganic particulate material composition; and/or v) first sheet light scattering coefficient greater than a second sheet light scattering coefficient of the paper product comprising the paper coating composition devoid of the co-processed microfibrillated cellulose and inorganic particulate material composition; and/or vi) a first porosity less than a second porosity of the paper product comprising the paper coating composition devoid of the co-processed microfibrillated cellulose and inorganic particulate material composition.

2. The paper product of paragraph 1, wherein the paper coating composition comprises a functional coating for liquid packaging, barrier coatings, or printed electronics applications.

3. The paper product of paragraph 1 or 2, further comprising a second coating comprising a polymer, a metal, an aqueous composition, or a combination thereof.

4. The paper product of paragraphs 1, 2 or 3, further having a first moisture vapour transmission rate (MVTR) greater than a second MVTR of the paper product comprising the paper coating composition devoid of the co-processed microfibrillated cellulose and inorganic particulate material composition.

5. The paper product of any of paragraphs 1-4, wherein the paper comprises from about 25 wt. % to about 35 wt. % of the co-processed microfibrillated cellulose and inorganic particulate material composition.

Microfibrillation in the Absence of Grindable Inorganic Particulate Material

In another aspect, the present invention is directed to a method for preparing an aqueous suspension comprising microfibrillated cellulose, the method comprising a step of microfibrillating a fibrous substrate comprising cellulose in an aqueous environment by grinding in the presence of a grinding medium which is to be removed after the completion of grinding, wherein the grinding is performed in a tower mill or a screened grinder, and wherein the grinding is carried out in the absence of grindable inorganic particulate material.

A grindable inorganic particulate material is a material which would be ground in the presence of the grinding medium.

The particulate grinding medium may be of a natural or a synthetic material. The grinding medium may, for example, comprise balls, beads or pellets of any hard mineral, ceramic or metallic material. Such materials may include, for example, alumina, zirconia, zirconium silicate, aluminium silicate or the mullite-rich material which is produced by calcining kaolinitic clay at a temperature in the range of from about 1300° C. to about 1800° C. For example, in some embodiments a Carbolite® grinding media is preferred. Alternatively, particles of natural sand of a suitable particle size may be used.

Generally, the type of and particle size of grinding medium to be selected for use in the invention may be dependent on the properties, such as, e.g., the particle size of, and the chemical composition of, the feed suspension of material to be ground. Preferably, the particulate grinding medium comprises particles having an average diameter in the range of from about 0.5 mm to about 6 mm. In one embodiment, the particles have an average diameter of at least about 3 mm.

The grinding medium may comprise particles having a specific gravity of at least about 2.5. The grinding medium may comprise particles have a specific gravity of at least about 3, or least about 4, or least about 5, or at least about 6.

The grinding medium (or media) may be present in an amount up to about 70% by volume of the charge. The grinding media may be present in amount of at least about 10% by volume of the charge, for example, at least about 20% by volume of the charge, or at least about 30% by volume of the charge, or at least about 40% by volume of the charge, or at least about 50% by volume of the charge, or at least about 60% by volume of the charge.

The fibrous substrate comprising cellulose may be microfibrillated to obtain microfibrillated cellulose having a $d_{50}$ ranging from about 5 to μm about 500 μm, as measured by laser light scattering. The fibrous substrate comprising cellulose may be microfibrillated to obtain microfibrillated cellulose having a $d_{50}$ of equal to or less than about 400 μm, for example equal to or less than about 300 μm, or equal to or less than about 200 μm, or equal to or less than about 150 μm, or equal to or less than about 125 μm, or equal to or less than about 100 μm, or equal to or less than about 90 μm, or equal to or less than about 80 μm, or equal to or less than about 70 μm, or equal to or less than about 60 μm, or equal to or less than about 50 μm, or equal to or less than about 40 μm, or equal to or less than about 30 μm, or equal to or less than about 20 μm, or equal to or less than about 10 μm.

The fibrous substrate comprising cellulose may be microfibrillated to obtain microfibrillated cellulose having a modal fibre particle size ranging from about 0.1-500 μm, as measured by laser light scattering. The fibrous substrate comprising cellulose may be microfibrillated in the presence to obtain microfibrillated cellulose having a modal fibre particle size of at least about 0.5 μm, for example at least about 10 μm, or at least about 50 μm, or at least about 100 μm, or at least about 150 μm, or at least about 200 μm, or at least about 300 μm, or at least about 400 μm.

The fibrous substrate comprising cellulose may be microfibrillated to obtain microfibrillated cellulose having a fibre steepness equal to or greater than about 10, as measured by Malvern (laser light scattering). Fibre steepness (i.e., the steepness of the particle size distribution of the fibres) is determined by the following formula:

$$\text{Steepness}=100\times(d_{30}/d_{70})$$

The microfibrillated cellulose may have a fibre steepness equal to or less than about 100. The microfibrillated cellulose may have a fibre steepness equal to or less than about 75, or equal to or less than about 50, or equal to or less than about 40, or equal to or less than about 30. The microfibrillated cellulose may have a fibre steepness from about 20 to about 50, or from about 25 to about 40, or from about 25 to about 35, or from about 30 to about 40.

In one embodiment, the grinding vessel is a tower mill. The tower mill may comprise a quiescent zone above one or more grinding zones. A quiescent zone is a region located towards the top of the interior of a tower mill in which minimal or no grinding takes place and comprises microfibrillated cellulose and inorganic particulate material. The quiescent zone is a region in which particles of the grinding medium sediment down into the one or more grinding zones of the tower mill.

The tower mill may comprise a classifier above one or more grinding zones. In an embodiment, the classifier is top mounted and located adjacent to a quiescent zone. The classifier may be a hydrocyclone.

The tower mill may comprise a screen above one or more grind zones. In an embodiment a screen is located adjacent to a quiescent zone and/or a classifier. The screen may be sized to separate grinding media from the product aqueous suspension comprising microfibrillated cellulose and to enhance grinding media sedimentation.

In an embodiment, the grinding is performed under plug flow conditions. Under plug flow conditions the flow through the tower is such that there is limited mixing of the grinding materials through the tower. This means that at different points along the length of the tower mill the viscosity of the aqueous environment will vary as the fineness of the microfibrillated cellulose increases. Thus, in effect, the grinding region in the tower mill can be considered to comprise one or more grinding zones which have a characteristic viscosity. A skilled person in the art will understand that there is no sharp boundary between adjacent grinding zones with respect to viscosity.

In an embodiment, water is added at the top of the mill proximate to the quiescent zone or the classifier or the screen above one or more grinding zones to reduce the viscosity of the aqueous suspension comprising microfibrillated cellulose at those zones in the mill. By diluting the product microfibrillated cellulose at this point in the mill it has been found that the prevention of grinding media carry over to the quiescent zone and/or the classifier and/or the screen is improved. Further, the limited mixing through the tower allows for processing at higher solids lower down the tower and dilute at the top with limited backflow of the dilution water back down the tower into the one or more grinding zones. Any suitable amount of water which is effective to dilute the viscosity of the product aqueous suspension comprising microfibrillated cellulose may be added. The water may be added continuously during the grinding process, or at regular intervals, or at irregular intervals.

In another embodiment, water may be added to one or more grinding zones via one or more water injection points positioned along the length of the tower mill, the or each water injection point being located at a position which corresponds to the one or more grinding zones. Advantageously, the ability to add water at various points along the tower allows for further adjustment of the grinding conditions at any or all positions along the mill.

The tower mill may comprise a vertical impeller shaft equipped with a series of impeller rotor disks throughout its length. The action of the impeller rotor disks creates a series of discrete grinding zones throughout the mill.

In another embodiment, the grinding is performed in a screened grinder, preferably a stirred media detritor. The screened grinder may comprise one or more screen(s) having a nominal aperture size of at least about 250 μm, for example, the one or more screens may have a nominal aperture size of at least about 300 μm, or at least about 350 μm, or at least about 400 μm, or at least about 450 μm, or at least about 500 μm, or at least about 550 μm, or at least about 600 μm, or at least about 650 μm, or at least about 700 μm, or at least about 750 μm, or at least about 800 μm, or at least about 850 μm, or at or least about 900 μm, or at least about 1000 μm.

The screen sizes noted immediately above are applicable to the tower mill embodiments described above.

As noted above, the grinding is performed in the presence of a grinding medium. In an embodiment, the grinding medium is a coarse media comprising particles having an average diameter in the range of from about 1 mm to about 6 mm, for example about 2 mm, or about 3 mm, or about 4 mm, or about 5 mm.

In another embodiment, the grinding media has a specific gravity of at least about 2.5, for example, at least about 3, or at least about 3.5, or at least about 4.0, or at least about 4.5, or least about 5.0, or at least about 5.5, or at least about 6.0.

As described above, the grinding medium (or media) may be in an amount up to about 70% by volume of the charge. The grinding media may be present in amount of at least about 10% by volume of the charge, for example, at least about 20% by volume of the charge, or at least about 30% by volume of the charge, or at least about 40% by volume of the charge, or at least about 50% by volume of the charge, or at least about 60% by volume of the charge.

In one embodiment, the grinding medium is present in amount of about 50% by volume of the charge.

By 'charge' is meant the composition which is the feed fed to the grinder vessel. The charge includes water, grinding media, the fibrous substrate comprising cellulose and any other optional additives (other than as described herein).

The use of a relatively coarse and/or dense media has the advantage of improved (i.e., faster) sediment rates and reduced media carry over through the quiescent zone and/or classifier and/or screen(s).

A further advantage in using relatively coarse screens is that a relatively coarse or dense grinding media can be used in the microfibrillating step. In addition, the use of relatively coarse screens (i.e., having a nominal aperture of least about 250 um) allows a relatively high solids product to be processed and removed from the grinder, which allows a relatively high solids feed (comprising fibrous substrate comprising cellulose and inorganic particulate material) to be processed in an economically viable process. As discussed below, it has been found that a feed having a high initial solids content is desirable in terms of energy sufficiency. Further, it has also been found that product produced (at a given energy) at lower solids has a coarser particle size distribution.

As discussed in the 'Background' section above, the present invention seeks to address the problem of preparing microfibrillated cellulose economically on an industrial scale.

Thus, in accordance with one embodiment, the fibrous substrate comprising cellulose is present in the aqueous environment at an initial solids content of at least about 1 wt %. The fibrous substrate comprising cellulose may be present in the aqueous environment at an initial solids content of at least about 2 wt %, for example at least about 3 wt %, or at least about at least 4 wt %. Typically the initial solids content will be no more than about 10 wt %.

In another embodiment, the grinding is performed in a cascade of grinding vessels, one or more of which may comprise one or more grinding zones. For example, the fibrous substrate comprising cellulose may be ground in a cascade of two or more grinding vessels, for example, a cascade of three or more grinding vessels, or a cascade of four or more grinding vessels, or a cascade of five or more grinding vessels, or a cascade of six or more grinding vessels, or a cascade of seven or more grinding vessels, or a cascade of eight or more grinding vessels, or a cascade of nine or more grinding vessels in series, or a cascade comprising up to ten grinding vessels. The cascade of grinding vessels may be operatively inked in series or parallel or a combination of series and parallel. The output from and/or the input to one or more of the grinding vessels in the cascade may be subjected to one or more screening steps and/or one or more classification steps.

The total energy expended in a microfibrillation process may be apportioned equally across each of the grinding vessels in the cascade. Alternatively, the energy input may vary between some or all of the grinding vessels in the cascade.

A person skilled in the art will understand that the energy expended per vessel may vary between vessels in the cascade depending on the amount of fibrous substrate being microfibrillated in each vessel, and optionally the speed of grind in each vessel, the duration of grind in each vessel and the type of grinding media in each vessel. The grinding conditions may be varied in each vessel in the cascade in order to control the particle size distribution of the microfibrillated cellulose.

In an embodiment the grinding is performed in a closed circuit. In another embodiment, the grinding is performed in an open circuit.

As the suspension of material to be ground may be of a relatively high viscosity, a suitable dispersing agent may preferably be added to the suspension prior to grinding. The dispersing agent may be, for example, a water soluble condensed phosphate, polysilicic acid or a salt thereof, or a polyelectrolyte, for example a water soluble salt of a poly (acrylic acid) or of a poly(methacrylic acid) having a number average molecular weight not greater than 80,000. The amount of the dispersing agent used would generally be in the range of from 0.1 to 2.0% by weight, based on the weight of the dry inorganic particulate solid material. The suspension may suitably be ground at a temperature in the range of from 4° C. to 100° C.

Other additives which may be included during the microfibrillation step include: carboxymethyl cellulose, amphoteric carboxymethyl cellulose, oxidising agents, 2,2,6,6-Tetramethylpiperidine-1-oxyl (TEMPO), TEMPO derivatives, and wood degrading enzymes.

The pH of the suspension of material to be ground may be about 7 or greater than about 7 (i.e., basic), for example, the pH of the suspension may be about 8, or about 9, or about 10, or about 11. The pH of the suspension of material to be ground may be less than about 7 (i.e., acidic), for example, the pH of the suspension may be about 6, or about 5, or about 4, or about 3. The pH of the suspension of material to be ground may be adjusted by addition of an appropriate amount of acid or base. Suitable bases included alkali metal hydroxides, such as, for example NaOH. Other suitable bases are sodium carbonate and ammonia. Suitable acids included inorganic acids, such as hydrochloric and sulphuric acid, or organic acids. An exemplary acid is orthophosphoric acid.

The total energy input in a typical grinding process to obtain the desired aqueous suspension composition may typically be between about 100 and 1500 $kWht^{-1}$ based on the total dry weight of the inorganic particulate filler. The total energy input may be less than about 1000 $kWht^{-1}$, for example, less than about 800 $kWht^{-1}$, less than about 600 $kWht^{-1}$, less than about 500 $kWht^{-1}$, less than about 400 $kWht^{-1}$, less than about 300 $kWht^{-1}$, or less than about 200 $kWht^{-1}$. As such, the present inventors have surprisingly found that a cellulose pulp can be microfibrillated at relatively low energy input when it is co-ground in the presence of an inorganic particulate material. As will be apparent, the total energy input per tonne of dry fibre in the fibrous substrate comprising cellulose will be less than about 10,000 $kWht^{1}$, for example, less than about 9000 $kWht^{-1}$, or less than about 8000 $kWht^{-1}$, or less than about 7000 $kWht^{-1}$, or less than about 6000 $kWht^{-1}$, or less than about 5000 $kWht^{-1}$, for example less than about 4000 kWht−1, less than about 3000 $kWht^{-1}$, less than about 2000 $kWht^{-1}$, less than about 1500 $kWht^{-1}$, less than about 1200 $kWht^{-1}$, less than about 1000 $kWht^{-1}$, or less than about 800 $kWht^{-1}$. The total energy input varies depending on the amount of dry fibre in the fibrous substrate being microfibrillated, and optionally the speed of grind and the duration of grind.

The following procedure may be used to characterise the particle size distributions of mixtures of minerals (GCC or kaolin) and microfibrillated cellulose pulp fibres.

Calcium Carbonate

A sample of co-ground slurry sufficient to give 3 g dry material is weighed into a beaker, diluted to 60 g with deionised water, and mixed with 5 $cm^3$ of a solution of sodium polyacrylate of 1.5 w/v % active. Further deionised water is added with stirring to a final slurry weight of 80 g.

Kaolin

A sample of co-ground slurry sufficient to give 5 g dry material is weighed into a beaker, diluted to 60 g with deionised water, and mixed with 5 $cm^3$ of a solution of 1.0 wt % sodium carbonate and 0.5 wt % sodium hexametaphosphate. Further deionised water is added with stirring to a final slurry weight of 80 g.

The slurry is then added in 1 $cm^3$ aliquots to water in the sample preparation unit attached to the Mastersizer S until the optimum level of obscuration is displayed (normally 10-15%). The light scattering analysis procedure is then carried out. The instrument range selected was 300RF: 0.05-900, and the beam length set to 2.4 mm.

For co-ground samples containing calcium carbonate and fibre the refractive index for calcium carbonate (1.596) is used. For co-ground samples of kaolin and fibre the RI for kaolin (1.5295) is used.

The particle size distribution is calculated from Mie theory and gives the output as a differential volume based distribution. The presence of two distinct peaks is interpreted as arising from the mineral (finer peak) and fibre (coarser peak).

The finer mineral peak is fitted to the measured data points and subtracted mathematically from the distribution to leave the fibre peak, which is converted to a cumulative distribution. Similarly, the fibre peak is subtracted mathematically from the original distribution to leave the mineral peak, which is also converted to a cumulative distribution. Both these cumulative curves may then be used to calculate the mean particle size ($d_{50}$) and the steepness of the distribution ($d_{30}/d_{70}\times100$). The differential curve may be used to find the modal particle size for both the mineral and fibre fractions.

EXAMPLES

Unless otherwise specified, paper properties were measured in accordance with the following methods:

- Burst strength: Messemer Büchnel burst tester according to SCAN P 24.
- Tensile strength: Testometrics tensile tester according to SCAN P 16.
- Bendtsen porosity: Measured using a Bendtsen Model 5 porosity tester in accordance with SCAN P21, SCAN P60, BS 4420 and Tappi UM 535.
- Bulk: This is the reciprocal of the apparent density as measured according to SCAN P7.
- ISO Brightness: The ISO brightness of handsheets was measured by means of an Elrepho Datacolour 3300 brightness meter fitted with a No. 8 filter (457 nm wavelength), according to ISO 2470: 1999 E.
- Opacity: The opacity of a sample of paper is measured by means of an Elrepho Datacolor 3300 spectro-photometer using a wavelength appropriate to opacity measurement. The standard test method is ISO 2471. First, a measurement of the percentage of the incident light reflected is made with a stack of at least ten sheets of paper over a black cavity (Rinfinity). The stack of sheets is then replaced with a single sheet of paper, and a second measurement of the percentage reflectance of the single sheet on the black cover is made (R). The percentage opacity is then calculated from the formula: Percentage opacity=100×R/Rinfinity.
- Tear strength: TAPPI method T 414 om-04 (Internal tearing resistance of paper (Elmendorf-type method)).
- Internal (z-direction) strength using a Scott bond tester according to TAPPI T569.
- Gloss: TAPPI method T 480 om-05 (Specular gloss of paper and paperboard at 75 degrees) may be used.
- Stiffness: The stiffness measurement method described in J. C. Husband, L. F. Gate, N. Norouzi, and D. Blair. "The Influence of kaolin Shape Factor on the Stiffness of Coated Papers", TAPPI Journal, June 2009, p. 12-17 (see in particular the section entitled 'Experimental Methods'); and J. C. Husband, J. S. Preston, L. F. Gate, A. Storer, and P. Creaton, "The Influence of Pigment Particle Shape on the In-Plane tensile Strength Properties of Kaolin-based Coating Layers", TAPPI Journal, December 2006, p. 3-8 (see in particular the section entitled 'Experimental Methods').

L&W Bending resistance (force required to bend a sheet through a given angle in mN: measured according to SCAN-P29:84.

Cationic demand (or anionic charge): measured in Mutek PCD 03; samples were titrated with Polydadmac (average molecular weight of about 60000) with conc. 1 mEq/L (purchased from PTE AB/Selcuk Dolen). The pulp mixture was filtered before the determination but not the white water samples. Before sample testing a calibration test is run to check the approximate consumption of polyelectrolyte. In sample testing the polyelectrolytes are dosed in batches (about 10 times) with 30 s intervals.

Sheet light scattering and absorption coefficients are measured using reflectance data from the Elrepho instrument: R Inf=reflectance of stack of 10 sheets, Ro=reflectance of 1 sheet over a black cup. These values and the substance ($gm^{-2}$) of the sheet are inputted into the Kubelka—Munk equations described in "Paper Optics" by Nils Pauler, (published by Lorentzen and Wettre, ISBN 91-971-765-6-7), p. 29-36.

First-pass retention is determined on the basis of the solids measurement in the headbox (HD) and in the white water (WW) tray and is calculated according to the following formula: Retention=[(HBsolids−WWsolids)/HBsolids]×100

Ash retention is determined following the same principles as first-pass retention, but based on the weight of the ash component in the headbox (HB) and in the white water (WW) tray, and is calculated according to the following formula: Ash retention=[(HBash−WWash)/HBash]×100

Formation index (PTS) is determined using the DOMAS software developed by PTS in accordance with the measurement method described in section 10-1 of their handbook, 'DOMAS 2.4 User Guide'

Example 1

Preparation of Co-Processed Filler

Composition 1

The starting materials for the grinding work consisted of a slurry of pulp (Northern bleached kraft pine) and a ground calcium carbonate (GGC) filler, Intracarb 60™, comprising about 60% by volume of particles less than 2 μm. The pulp was blended in a Cellier mixer with the GCC to give a nominal 6% addition of pulp by weight. This suspension, which was at 26.5% solids, was then fed into a 180 kW stirred media mill containing ceramic grinding media (King's, 3 mm) at a medium volume concentration of 50%. The mixture was ground until an energy input between 2000 and 3000 $kWht^{-1}$ (expressed on pulp alone) had been expended and then the pulp/mineral mixture was separated from the media using a 1 mm screen. The product had a fibre content (by ashing) of 6.5 wt %, and a mean fibre size (D50) of 129 μm as measured using a Malvern Mastersizer S™. The fibre psd steepness (D30/D70×100) was 31.7.

Composition 2

The preparation of this filler followed the procedure outlined in composition 1. The pulp was blended in a Cellier mixer with the Intracarb 60 to give a 20% addition of pulp. This suspension, which was at 10-11% solids, was then fed into a 180 kW stirred media mill containing ceramic grinding media (King's, 3 mm) at a medium volume concentration of 50%. The mixture was ground until an energy input between 2500 and 4000 $kWht^{-1}$ (expressed on pulp alone) had been expended and then the pulp/mineral mixture was separated from the media using a 1 mm screen. The product had a fibre content (by ashing) of 19.7 wt %, and a mean fibre size (D50) of 79.7 μm as measured using a Malvern Mastersizer S™. The fibre psd steepness (D30/D70×100) was 29.3. Before addition to the paper machine the fibre content was reduced to 11.4 wt % by blending in an approximately 50/50 ratio with GCC (Intracarb 60™).

Example 2

Preparation of Basepaper

A blend of 80% by weight of *eucalyptus* pulp (Södra Tofte) refined to 27° SR at 4.5% solids and 20% by weight of softwood kraft (Sodra Mönsterås) pulp refined to 26° SR at 3.5% solids was prepared in pilot scale equipment. This pulp blend was used to make a continuous reel of paper using a pilot scale paper machine running at 800 m $min^{-1}$. The stock was fed to the twin wire roll former via a 13 mm slot from a UMV10 headbox. The target grammage of the paper was 75 $gm^{-2}$ and fillers and loading levels are set out in Table 1.

TABLE 1

Uncoated basepaper properties before calendering

| | Filler | | | |
|---|---|---|---|---|
| | IC60 control | | Comp. 1 | Comp. 2 |
| Loading, wt % | 19.9 | 27.8 | 27.9 | 28.5 |
| Grammage, $gm^{-2}$ | 74.5 | 74.1 | 77.8 | 71.9 |
| Tensile strength Nm $g^{-1}$ | 34.0 | 26.5 | 26.9 | 29.4 |
| Bendtsen porosity, $cm^3$ $min^{-1}$ | 735 | 749 | 367 | 296 |

A 2-component retention aid system was used consisting of a cationic polyacrylamide, Percol 47NS™, (BASF) at a dose of 300-380 g $t^{-1}$ and a microparticle bentonite, Hydrocol SH™ at 2 kg $t^{-1}$. The press section consists of one double felted roll press running at a linear load of 10 kN $m^{-1}$ followed by two Metso SymBelt presses with the shoe length of 250 mm running at 600 and 800 kN $m^{-1}$ respectively. The rolls in the two shoe presses are inverted in relation to each other.

The paper was dried using heated cylinders.

Application of a Barrier Coating

A coating was applied to each of the basepapers. The formulation consisted of 100 parts of a high shape factor kaolin (Barrisurf HX™) and 100 parts of a styrene-butadiene copolymer latex (DL930™, Styron). The solids content was 50.1 wt % and the Brookfield 100 rpm viscosity was 80 mPa·s. Coatings were applied by hand using a suitable wirewound rod to give a coat weight of 13-14 $gm^{-2}$. Drying was accomplished using a hot air dryer.

Example 3

The coated papers of Example 2 were then tested for moisture vapour transmission rate (MVTR) over 2 days. The method was based on TAPPI T448 but used silica gel as the dessicant and a relative humidity of 50%. The amount of moisture transferred through the paper was measured over the first and second days and then averaged. Results are summarized in Table 2.

The papers were also tested for oil resistance using an oil-based solution of Sudan Red IV in dibutyl phthalate using an IGT printing unit. A controlled volume of the fluid (5.8 μl) was applied to the paper using a syringe and passed through the printing nip at a pressure of 5 kgf and a speed of 0.5 m $s^{-1}$. The area covered by the fluid stain was measured using image analysis and used as an indication of the ability of the coating to resist penetration by oil-based fluids. Results are summarized in Table 2.

TABLE 2

Coated basepaper properties

| | Filler | | | |
|---|---|---|---|---|
| | IC60 control | | Comp. 1 | Comp. 2 |
| Loading, wt % | 19.9 | 27.8 | 27.9 | 28.5 |
| MVTR $gm^{-2}$/day | 44.1 | 40.4 | 40.4 | 36.3 |
| Stain area, pixels | 62592 | 70855 | 73749 | 75672 |

These results show that the paper containing co-ground filler at the highest fibre level (composition 2) has a lower moisture vapour transmission rate than the control. Coated papers on both compositions 1 and 2 have higher stain areas indicating improved fluid resistance.

Example 4

Preparation of Co-Processed Filler

Composition 3

The starting materials for the grinding work consisted of a slurry of pulp (Botnia pine) and a ground calcium carbonate filler, Intracarb 60™. The pulp was blended in a Cellier mixer with the Intracarb to give a nominally 20 wt % addition of pulp. This suspension, which was at 10-11% solids, was then fed into a 180 kW stirred media mill containing ceramic grinding media (King's, 3 mm) at a medium volume concentration of 50%. The mixture was ground until an energy input between 2500 and 4000 $kWht^{-1}$ had been expended and then the pulp/mineral mixture was separated from the media using a 1 mm screen. The product had a fibre content (by ashing) of 19.7 wt %, and a mean fibre size (D50) of 79.7 μm as measured using a Malvern Mastersizer S™. The fibre psd steepness (D30/D70×100) was 29.3. Before addition to the paper machine (see Example 5 below) the fibre content was reduced by blending 9 parts by weight of the composition containing 19.7 wt % fibre with 23 parts of fresh Intracarb 60 to give a fibre content, measured by ash, of 5.8 wt %.

Composition 4

A second filler composition was prepared by blending 50 parts by weight of composition 3, containing 19.7 wt % fibre, with 50 parts of fresh Intracarb 60 to give a fibre content, measured by ash, of 11.4 wt %.

Example 5

Preparation of Paper

A blend of 80% by weight of *eucalyptus* pulp (Södra Tofte) refined to 27° SR at 4.5% solids and 20% by weight of softwood kraft (Sodra Mönsterås) pulp refined to 26° SR at 3.5% solids was prepared in pilot scale equipment. This pulp blend was used to make a continuous reel of paper using a pilot scale paper machine running at 800 m $min^{-1}$. The stock was fed to the twin wire roll former via a 13 mm slot from a UMV10 headbox. The target grammage of the paper was 75 $gm^2$ and fillers and loading levels are set out in Table 1. A 2-component retention aid system was used consisting of a cationic polyacrylamide, Percol 47NS™, (BASF) at a dose of 300-380 g $t^{-1}$ and a microparticle bentonite, Hydrocol SH™ at 2 kg $t^{-1}$. The press section consists of one double felted roll press running at a linear load of 10 kN $m^{-1}$ followed by two Metso SymBelt presses with the shoe length of 250 mm running at 600 and 800 kN $m^{-1}$ respectively. The rolls in the two shoe presses are inverted in relation to each other.

The paper was dried using heated cylinders.

Table 3 below lists the wet end measurements made during the papermaking stage. Paper properties are summarised in Table 4.

These data show that the co-ground fillers do not significantly contribute to the anionic trash in the white water recirculation, and do not have a detrimental effect on total retention, whist improving the ash retention. Finally, the formation of the paper is improved by the addition of co-ground filler.

TABLE 3

Paper machine parameters

| | IC60 Control | | Comp. 3 | Comp. 4 |
|---|---|---|---|---|
| Loading, wt % | 19.9 | 27.8 | 27.4 | 28.5 |
| Retention aid dose, g $t^{-1}$ | 300 | 380 | 380 | 380 |
| Cationic demand of white water, μeq $g^{-1}$ | 0.0225 | 0.0195 | 0.0195 | 0.0210 |
| Total 1st pass retention, wt % | 72.4 | 73.9 | 74.1 | 70.8 |
| Ash retention, wt % | 43.7 | 35.1 | 51.1 | 44.7 |
| Formation index, PTS | 842 | 800 | 636 | 668 |

TABLE 4

Paper properties

| | IC60 control | | Comp. 3 | Comp. 4 |
|---|---|---|---|---|
| Loading, wt % | 19.9 | 27.8 | 27.4 | 28.5 |
| Grammage, $gm^{-2}$ | 74.5 | 74.1 | 77.3 | 71.9 |
| Burst strength index, Nm $g^{-1}$ | 19.3 | 15.5 | 18.1 | 19.8 |
| Tensile strength index, Nm $g^{-1}$ | 34.0 | 26.5 | 27.4 | 29.4 |
| Tear strength index, Nm $g^{-1}$ | 4.12 | 3.41 | 3.83 | 4.12 |
| Scott bond strength, $Jm^{-2}$ | 136.6 | 122.2 | 134.2 | 131.8 |
| Sheet light scattering coefficient, $m^2kg^{-1}$, filters 8 and 10 | 61.5 (F8)<br>58.0 (F10) | 68.0 (F8)<br>63.8 (F10) | 69.9 (F8)<br>65.4 (F10) | 71.3 (F8)<br>66.2 (F10) |
| Sheet light absorption coefficient, $m^2kg^{-1}$, filters 8 and 10 | 0.381 (F8)<br>0.136 (F10) | 0.385 (F8)<br>0.143 (F10) | 0.407 (F8)<br>0.160 (F10) | 0.419 (F8)<br>0.170 (F10) |

These results show that the papers containing co-ground filler (compositions 3 and 4) have an unusual combination of strength properties. Normally in pulp refining, if tensile strength increases, tear decreases. In these examples, both tensile and tear strength increase at the same time. Scott bond internal strength also improves.

Normally, if tensile strength increases, sheet light scatter decreases. In this instance, both increase.

Example 6

Preparation of Co-Ground Filler

The starting materials for the grinding work consisted of a slurry of pulp (Botnia pine) and a ground calcium carbonate filler. Intracarb 60™. The pulp was blended in a Cellier mixer with the GCC to give a 20% addition of pulp. This suspension, which was at 8.8% solids, was then fed into a 180 kW stirred media mill containing a ceramic grinding media (King's, 3 mm) at a media volume concentration of 50%. The mixture was ground until an energy input between 2500 $kWht^{-1}$ had been expended and then the pulp/mineral mixture was separated from the media using a 1 mm screen. The product had a fibre content (by ashing) of 19.0 wt %, and a mean fibre size ($d_{50}$) of 79 μm as measured using a Malvern Mastersizer S™. The fibre psd steepness ($d_{30}/d_{70}\times 100$) was 30.7.

Example 7

Preparation of Base Paper

A blend of 56% by weight of Fibria eucalyptus pulp refined to 33 SR (100 kWh/t), 14% Botnia RMA 90 softwood kraft pulp beaten to 31 SR, and 30% by weight of coated woodfree broke containing 50% by weight of GCC (Royal Web Silk) was prepared at 3% solids in water using a pilot scale hydrapulper.

This pulp blend was used to make a continuous reel of paper using a pilot scale Fourdrinier machine running at 12 m $min^{-1}$. The target grammage of the paper was 73-82 $gm^{-2}$ and fillers and loading levels are set out in Table 1. A cationic polymeric retention aid (Percol E622, BASF) was added at a dose of 200 g $t^{-1}$ (10% loading) or 300 g $t^{-1}$ (15-20% loading). The paper was dried using heated cylinders.

The basepaper was calendered for 1 nip on machine using a steel roll calendar at 20 kN pressure. The properties of the papers after calendering are summarised in Table 5.

These results show that the paper containing co-ground filler has higher burst and tensile strength than the control. The bending resistance is also increased. The porosity however, is much reduced. The sheets containing the highest amount of coground filler have improved surface smoothness to those containing the control chalk.

TABLE 5

Uncoated woodfree basepaper properties after calendering

| | Control 5% broke filler 10% IC60* | Base 1 5% broke filler 10% Ex 6 | Base 2 5% broke filler 15% Ex. 6 | Base 3 5% broke filler 20% Ex 6 |
|---|---|---|---|---|
| Loading, wt % | 15.1 | 15.8 | 19.7 | 23.4 |
| Grammage, $gm^{-2}$ | 72.8 | 74.4 | 77.6 | 82.2 |
| Geometric mean tensile strength Nm $g^{-1}$ | 33.3 | 35.0 | 31.4 | 33.8 |
| Burst strength Nm $g^{-1}$ | 19.9 | 22.2 | 21.2 | 21.4 |

TABLE 5-continued

Uncoated woodfree basepaper properties after calendering

| | Control 5% broke filler 10% IC60* | Base 1 5% broke filler 10% Ex 6 | Base 2 5% broke filler 15% Ex. 6 | Base 3 5% broke filler 20% Ex 6 |
|---|---|---|---|---|
| Geometric mean bending force, L&W, mN | 3.22 | 3.41 | 4.15 | 4.2 |
| Bendtsen porosity, $cm^3$ $min^{-1}$ | 1202 | 842 | 592 | 577 |
| Bendtsen smoothness $cm^3$ $min^{-1}$ | 350 | 340 | 342 | 286 |
| Wireside | | | | |
| ISO Brightness | 76.7 | 76.6 | 77.5 | 78.0 |
| Opacity, % | 80.6 | 80.6 | 84.4 | 85.9 |

*Intracarb 60 ™

Example 8

A coating mix was prepared according to the following formulation:

- 85 parts ultrafine ground calcium carbonate (Carbital 95™) comprising about 95% by volume of particles less than 2 μm
- 15 parts fine glossing kaolin (Hydragloss 90™ KaMin)
- 11 pph styrene-butadiene-acrylonitrile latex (DL920™, Styron)
- 0.3 pph CMC (Finnfix, CP Kelco)
- 1 pph calcium stearate (Nopcote C104).

The pH was adjusted to 8.0 with NaOH and the solids to 65.5 wt %. The viscosity, measured using a Brookfield viscometer at 100 rpm was 270 mPa·s. This was applied to samples of the basepapers in Table 5 using a laboratory coater (Hell-Coater™) at a speed of 600 m $min^{-1}$. Coat weights of between 7.0 and 12.0 $gm^{-2}$ was applied and adjusted by control of blade displacement.

After conditioning at 23° C. and 50% RH, all the coated paper samples produced were then supercalendered for 10 nips using a Perkins laboratory calendar. The pressure was 50 bar at a roll temperature of 65° C. and a speed of 40 m $min^{-1}$.

The coated and calendered strips were then tested for smoothness (Parker Print Surf, ISO 8971-4), 75° TAPPI gloss (T480), and coverage using a burn-out procedure followed by image analysis of the grey level image. The procedure involves treating the paper with an alcoholic solution of ammonium chloride, followed by heating to 200° C. for 10 minutes to char the basepaper fibres. The grey level of the paper is a measure of the ability of the coating layer to cover the blackened fibres. Values for grey level close to 0 indicate poor coverage (black) whilst higher values indicate higher whiteness and therefore better coverage.

Results for a coat weight of 12 $gm^{-2}$ are summarised in Table 6.

Samples of the coated paper were also tested for their printing properties. Papers were printed using an IGT Printing Unit at a speed of 0.5 m $s^{-1}$ and a pressure of 500N. A magenta sheetfed offset ink was used, applying a volume of 0.1 $cm^3$. The gloss of the printed ink layer was measured using a Hunterlab 75° glossmeter according to the TAPPI T480 standard. The ink density was measured using a Gretag Spectroeye™ densitometer. The picking speed of the coating was measured with the IGT Printing Unit in acceleration mode using a standard low viscosity oil. The printing speed was accelerated from 0-6 m $s^{-1}$ and the distance on the coated strip when damage first occurred was measured and quoted as a printing velocity. Higher values mean that the coating is stronger.

TABLE 6

Coated paper properties

| Base | Loading, wt % | 75° TAPPI gloss | PPS smoothness μm, 1000 Pa | Burn-out, average grey level | Print gloss, 75° | Print density | Dry pick velocity cm $s^{-1}$ |
|---|---|---|---|---|---|---|---|
| Control | 15.1 | 64 | 1.29 | 111.6 | 70 | 1.50 | 183 |
| Base 1 | 15.8 | 63 | 1.21 | 114.6 | 70 | 1.51 | 194 |
| Base 2 | 19.7 | 71 | 1.17 | 140.9 | 77 | 1.53 | 191 |
| Base 3 | 23.4 | 68 | 1.30 | 129.9 | 75 | 1.46 | 198 |

The results show that substituting a co-ground filler containing microfibrillated cellulose for a standard GCC filler gives improvements in coated sheet quality when the paper is subsequently coated. The coated paper surface has higher gloss, better smoothness and the coated layer has better coverage according to the burnout test (higher grey level values). Printing properties are also improved with the ink layer having a higher gloss. It was also found that the dry pick strength increased when filler containing microfibrillated cellulose was used in the base.

Example 9

Preparation of Co-Ground Filler

The starting materials for the grinding work consisted of a slurry of pulp (Botnia pine) and a ground calcium carbonate filler, Polcarb 60™, comprising about 60% by volume of particles less than 2 μm. The pulp was blended in a Cellier mixer with the Polcarb to give a 20% addition of pulp. This suspension, which was at 8.7% solids, was then fed into a 180 kW stirred media mill containing a ceramic grinding media (King's, 3 mm) at a media volume concentration of 50%. The mixture was ground until an energy input between 2500 $kWht^{-1}$ had been expended and then the pulp/mineral mixture was separated from the media using a 1 mm screen. The product had a fibre content (by ashing) of 20.7 wt %, and a mean fibre size ($d_{50}$) of 79 μm as measured using a Malvern Mastersizer S™. The fibre psd steepness ($d_{30}/d_{70}\times 100$) was 29.5.

Example 10

Preparation of Basepaper

A blend of 40% by weight of Pressurised groundwood pulp, 40% Botnia RMA 90 softwood kraft pulp beaten to 31 SR and 20% by weight of coated LWC broke containing 50/50 GCC/kaolin was prepared at 3% solids in water using a pilot scale hydrapulper.

This pulp blend was used to make a continuous reel of paper using a pilot scale Fourdrnier machine running at 16 m $min^{-1}$. The target grammage of the paper was 38-43 $gm^{-2}$ and fillers and loading levels are set out in Table 7. A cationic polymeric retention aid (Percol 230 L, BASF) was added at a dose of 200 g $t^{-1}$ (10% loading) or 300 g $t^{-1}$ (15-20% loading). The paper was dried using heated cylinders.

The basepaper was calendered for 1 nip on machine using a steel roll calendar at 20 kN pressure. The properties of the papers after calendering are summarised in Table 7.

These results show that the paper containing co-ground filler has higher burst and tensile strength than the control. The bending resistance is also increased. The porosity however, is much reduced. The sheets containing the highest amount of co-ground filler have improved surface smoothness to those containing the control chalk.

TABLE 7

Uncoated basepaper properties after calendering

| | Control 5% broke filler 6% Polcarb 60 | Base 1 5% broke filler 5% Ex 9 | Base 2 5% broke filler 10% Ex. 9 | Base 3 5% broke filler 14% Ex 9 |
|---|---|---|---|---|
| Loading, wt % | 11.2 | 10.1 | 15.4 | 18.8 |
| Grammage, $gm^{-2}$ | 38.2 | 38.2 | 42.0 | 43.0 |
| Geometric mean tensile strength Nm $g^{-1}$ | 26.8 | 32.4 | 30.4 | 28.4 |
| Burst strength Nm $g^{-1}$ | 14.8 | 17.4 | 16.0 | 15.4 |
| Geo. mean bending force, L&W, mN | 3.22 | 3.41 | 4.15 | 4.2 |
| Bendtsen porosity, $cm^3$ $min^{-1}$ | 1202 | 842 | 592 | 577 |
| Bendtsen smoothness $cm^3$ $min^{-1}$ | 350 | 340 | 342 | 286 |
| Wireside | | | | |
| ISO Brightness | 76.7 | 76.6 | 77.5 | 78.0 |
| Opacity, % | 80.6 | 80.6 | 84.4 | 85.9 |

Example 11

A coating mix was prepared according to the following formulation:

60 parts fine ground calcium carbonate (Carbital 90™) comprising about 90% by volume of particles less than 2 μm 40 parts fine Brazilian kaolin (Capim DG™)

8 pph styrene-butadiene-acrylonitrile latex (DL920™, Styron)

4 pph starch (Cargill C*film)

1 pph calcium stearate (Nopcote C104).

The pH was adjusted to 8.0 with NaOH and the solids to 67.5 wt %. The viscosity, measured using a Brookfield viscometer at 100 rpm was 270 mPa·s. This was applied to samples of the basepapers in Table 7 using a laboratory coater (Heli-Coater™) at a speed of 600 m $min^{-1}$. Coat weights of between 7.0 and 12.0 $gm^{-2}$ was applied and adjusted by control of blade displacement.

After conditioning at 23° C. and 50% RH, all the coated paper samples produced in Examples 3 and 4 were then supercalendered for 10 nips using a Perkins laboratory calendar. The pressure was 50 bar at a roll temperature of 65° C. and a speed of 40 m $min^{-1}$.

The coated and calendered strips were then tested for smoothness (Parker Print Surf, ISO 8971-4), 75° TAPPI gloss (T480), and coverage in accordance with Example 8 above.

Samples of the coated paper were also tested for their printing properties in accordance with Example 8 above.

Results interpolated to a coat weight of 10 $gm^{-2}$ are summarised in Table 8.

TABLE 8

| Coated paper properties | | | | | |
|---|---|---|---|---|---|
| Base | Loading, wt % | 75° TAPPI gloss | PPS smoothness μm, 1000 Pa | Burn-out, average grey level | Print gloss, 75° |
| Control | 11.2 | 48 | 1.36 | 142.3 | 62 |
| Base 1 | 10.1 | 50 | 1.35 | 135.9 | 62 |
| Base 2 | 15.4 | 54 | 1.17 | 161.0 | 66 |
| Base 3 | 18.8 | 52 | 1.20 | 148.5 | 65 |

The results show that substituting a co-ground filler containing microfibrillated cellulose for a standard chalk filler gives improvements in coated sheet quality when the paper is subsequently coated. The coated paper surface has higher gloss, better smoothness and the coated layer has better coverage according to the burnout test (generally higher grey level values). Printing properties are also improved with the ink layer having a higher gloss.

Example 11

400 g of unrefined bleached softwood kraft pulp (Botnia Pine RM90) was soaked in 20 liters of water for 6 hours, then slushed in a mechanical mixer. The stock so obtained was then poured into a laboratory Valley beater and refined under load for 28 mins to obtain a sample of refined pulp beaten to 525 $cm^3$ Canadian Standard Freeness (CSF).

The pulp was then dewatered using a consistency tester (Testing Machines Inc.) to obtain a pad of wet pulp at between 23.0-24.0 wt % solids. This was then used in co-grinding experiments as detailed below:

143 g of a slurry of Carbital 60HS™ (solids 77.7 wt %: about 60% by volume of particles less than 2 μm) was weighed into a grinding pot. 51.0 g of wet pulp was then added and mixed with the carbonate. 1485 g of King's 3 mm grinding media was then added followed by 423 g water to give a media volume concentration of 50%. The mixture was ground together at 1000 rpm until an energy input of 5,000-12,500 kWh/ton (expressed on fibre) had been expended. The product was separated from the media using a 600 μm BSS screen. The solids content of the resulting slurry was between 22.0-25.0 wt % and a Brookfield viscosity (100 rpm) of 1400-2930 mPa·s. The fibre content of the product was analysed by ashing at 450° C. and the size of the mineral and pulp fractions measured using a Malvern Mastersizer.

Further samples based on the same GCC and pulp were prepared using similar conditions but at higher pulp addition levels. The sample properties are listed in Table 9.

TABLE 9

| Conditions and properties of co-ground MFC - GCC slurries | | | | | |
|---|---|---|---|---|---|
| Sample | wt % MFC on mineral | Energy kWh/t MFC | MFC D50, μm, (Malvern) | Solids wt % | Brookfield viscosity, 100 rpm, mPa · s |
| 1 | 11.1 | 7500 | 41.6 | 22.0 | 2930 |
| 2 | 10.9 | 10,000 | 16.5 | 23.9 | 1685 |
| 3 | 10.9 | 12,500 | 12.5 | 25.0 | 1405 |
| 4 | 17.2 | 5,000 | 43 | 14.9 | 1815 |
| 5 | 15.7 | 10,000 | 16.4 | 17.4 | 1030 |
| 6 | 15.3 | 12,500 | 12.3 | 18.4 | 960 |
| 7 | 24.1 | 12,500 | 11.7 | 13.5 | 1055 |

Example 12

131 g of a slurry of Barrisurf HX™ (solids 53.0 wt %; shape fator=100) was weighed into a grinding pot. 33.0 g of wet pulp at 22.5 wt % solids was then added and mixed with the kaolin. 1485 g of King's 3 mm grinding media was then added followed by 429 g water to give a media volume concentration of 50%. The mixture was ground together at 1000 rpm until an energy input of between 5000 and 12,500 kWh/ton (expressed on fibre) had been expended. The products were separated from the media using a 600 μm BSS screen. The solids content of the resulting slurries was between 13.5-15.9 wt % and Brookfield viscosity (100 rpm) values between 1940 and 2600 mPa·s. The fibre content of the products was analysed by ashing at 450° C. and the size of the mineral and pulp fractions measured using a Malvern Mastersizer.

Further samples based on the same kaolin and pulp were prepared using similar conditions but at higher pulp addition levels. The sample properties are listed in Table 10.

TABLE 10

| Conditions and properties of co-ground MFC - kaolin slurries | | | | | |
|---|---|---|---|---|---|
| Sample | wt % MFC on mineral | Energy kWh/t MFC | MFC D50, μm, (Malvern) | Solids wt % | Brookfield viscosity, 100 rpm, mPa · s |
| 8 | 12.6 | 5000 | 52.2 | 13.5 | 2632 |
| 9 | 13.0 | 7500 | 34.3 | 14.3 | 2184 |
| 10 | 12.5 | 10,000 | 23 | 14.6 | 1940 |
| 11 | 13.4 | 12,500 | 18.2 | 15.9 | 2280 |
| 12 | 18.6 | 5000 | 42.5 | 14.1 | 4190 |
| 13 | 16.6 | 7500 | 24.8 | 16.2 | 4190 |
| 14 | 15.9 | 10,000 | 17 | 16.0 | 3156 |
| 15 | 16.4 | 12,500 | 13.6 | 16.1 | 2332 |
| 16 | 22.5 | 5000 | 41.9 | 14.3 | 6020 |
| 17 | 21.2 | 7500 | 28.2 | 14.4 | 5220 |
| 18 | 21.4 | 10,000 | 16.5 | 14.8 | 3740 |
| 19 | 20.0 | 12,500 | 11.9 | 18.1 | 4550 |
| 20 | 27.7 | 7500 | 31.4 | 13.6 | 4750 |
| 21 | 28.4 | 10,000 | 21.4 | 15.6 | 5050 |
| 22 | 32.3 | 12,500 | 13.6 | 17.4 | 6490 |

Example 13

Portions of the above slurries were applied onto a polyethylene terephthalate film (Terinex Ltd.) using a 150 μm film thickness wirewound rod (Sheen Instruments Ltd, Kingston, UK). The coatings were dried by the application of a hot air gun. The dried coatings were removed from the PET film and cut into barbell shapes 4 mm wide using a cutter designed for rubber testing. The tensile properties of the coatings were measured using a tensile tester (Testometric 350, Rochdale, UK). The procedure is described in the article by J. C. Husband, J. S. Preston. L. F. Gate, A. Storer, and P. Creaton, "*The Influence of Pigment Particle Shape on the In-Plane tensile Strength Properties of Kaolin-based Coating Layers*", TAPPI Journal, December 2006, p. 3-8 (see in particular the section entitled 'Experimental Methods'). The tensile strength of the coated films was calculated from the load at break and the elastic modulus from the initial slope of the stress vs. strain curve. The procedure is described in the article by J. C. Husband, L. F. Gate, N. Norouzi, and D. Blair, "*The Influence of kaolin Shape Factor on the Stiffness of Coated Papers*", TAPPI Journal, June 2009, p. 12-17 (see in particular the section entitled 'Experimental Methods').

The results for the mechanical properties are summarised in Tables 11 and 12.

TABLE 11 mechanical properties of co-ground MFC - GCC coatings

| Sample | wt % MFC on mineral | Energy kWh/t MFC | Tensile strength, MPa | Elastic modulus, GPa |
|---|---|---|---|---|
| 1 | 11.1 | 7500 | 0.78 | 0.44 |
| 2 | 10.9 | 10,000 | 0.90 | 0.68 |
| 3 | 10.9 | 12,500 | 0.74 | 0.65 |
| 4 | 17.2 | 5,000 | 0.68 | 0.35 |
| 5 | 15.7 | 10,000 | 1.33 | 0.75 |
| 6 | 15.3 | 12,500 | 1.36 | 0.83 |
| 7 | 24.1 | 12,500 | | |

These results show that a combination of MFC and high aspect ratio kaolin can produce strength and elastic modulus values. The elastic modulus would translate directly into improved coated paper stiffness, for example.

TABLE 12

Conditions and properties of co-ground MFC - Barrisurf HX coating

| Sample | wt % MFC on mineral | Energy kWh/t MFC | Tensile strength, MPa | Elastic modulus, GPa |
|---|---|---|---|---|
| 8 | 12.6 | 5000 | 1.93 | 1.29 |
| 9 | 13.0 | 7500 | 2.96 | 1.68 |
| 10 | 12.5 | 10,000 | 2.55 | 1.66 |
| 11 | 13.4 | 12,500 | 2.41 | 1.69 |
| 12 | 18.6 | 5000 | 2.25 | 1.45 |
| 13 | 16.6 | 7500 | 3.27 | 2.14 |
| 14 | 15.9 | 10,000 | 4.31 | 2.64 |
| 15 | 16.4 | 12,500 | 2.98 | 2.16 |
| 16 | 22.5 | 5000 | 2.91 | 2.11 |
| 17 | 21.2 | 7500 | 5.71 | 2.94 |
| 18 | 21.4 | 10,000 | 5.95 | 2.91 |
| 19 | 20.0 | 12,500 | 3.26 | 2.53 |
| 20 | 27.7 | 7500 | 6.62 | 2.86 |
| 21 | 28.4 | 10,000 | 5.53 | 2.54 |
| 22 | 32.3 | 12,500 | 5.33 | 2.67 |

The invention claimed is:

1. A paper product comprising a functional paper and a coating comprising at least about 5 wt. % of a co-processed microfibrillated cellulose and inorganic particulate material composition, wherein the microfibrillated cellulose has a fibre steepness of from about 20 to about 50.

2. The paper product of claim 1, wherein the coating comprises at least about 25 wt. % of the co-processed microfibrillated cellulose and inorganic particulate material composition.

3. The paper product of claim 1, wherein the coating consists essentially of a co-processed microfibrillated cellulose and inorganic particulate material composition.

4. The paper product of claim 1, wherein the functional paper is selected from the group consisting of white-lined board and linerboard.

5. The paper product of claim 1, wherein the inorganic particulate material is selected from the group consisting of kaolin, calcium carbonate, talc, and combinations thereof.

6. The paper product of claim 1, which is suitable for food packaging.

7. A method for coating a paper product comprising: providing at least about 5 wt. % of a co-processed microfibrillated cellulose and inorganic particulate material composition on the paper product to form a coating, wherein the microfibrillated cellulose has a fibre steepness of from about 20 to about 50.

8. The method of claim 7, wherein the coating comprises at least about 25 wt. % of the co-processed microfibrillated cellulose and inorganic particulate material composition.

9. The method of claim 7, wherein the coating comprises at least about 35 wt. % of the co-processed microfibrillated cellulose and inorganic particulate material composition.

10. The method of claim 7, wherein the coating consists essentially of a co-processed microfibrillated cellulose and inorganic particulate material composition.

11. The method of claim 7, wherein the paper product is selected from the group consisting of white-lined board and linerboard.

12. The method of claim 7, wherein the inorganic particulate material is selected from the group consisting of kaolin, calcium carbonate, talc, and combinations thereof.

13. The method of claim 7, wherein the providing is performed by a curtain coater.

14. A method of increasing at least one of the following properties in a paper product:

i) gloss;

ii) stiffness; and iii) a barrier property, wherein the method comprises coating the paper product with at least about 5 wt. % of a co-processed microfibrillated cellulose and inorganic particulate material composition on the paper product instead of a coating composition devoid of the co-processed microfibrillated cellulose and inorganic particulate material composition, wherein the microfibrillated cellulose has a fibre steepness of from about 20 to about 50.

15. The method of claim 14, wherein the method comprises coating the paper product with at least about 25 wt. % of a co-processed microfibriilated cellulose and inorganic particulate material composition on the paper product.

16. The method of claim 14, wherein the method comprises coating the paper product with at least about 35 wt. % of a co-processed microfibrillated cellulose and inorganic particulate material composition on the paper product.

17. The method of claim 14, wherein the paper product is selected from the group consisting of white-lined board and linerboard.

18. The method of claim 14, wherein the inorganic particulate material is selected from the group consisting of kaolin, calcium carbonate, talc, and combinations thereof.

19. The method of claim 14, wherein the coating is performed by a curtain coater.

20. The paper product of claim 1, wherein the coating comprises at least about 35 wt. % of the co-processed microfibrillated cellulose and inorganic particulate material composition.

* * * * *